US012781367B2

(12) United States Patent
Ono et al.

(10) Patent No.: US 12,781,367 B2
(45) Date of Patent: Nov. 3, 2026

(54) ELECTROLYTIC DEVICE

(71) Applicant: KABUSHIKI KAISHA TOSHIBA, Tokyo (JP)

(72) Inventors: Akihiko Ono, Kita Tokyo (JP); Yusuke Kofuji, Hiratsuka Kanagawa (JP); Yuki Kudo, Yokohama Kanagawa (JP); Satoshi Mikoshiba, Yamato Kanagawa (JP); Ryota Kitagawa, Setagaya Tokyo (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 765 days.

(21) Appl. No.: 18/176,837

(22) Filed: Mar. 1, 2023

(65) Prior Publication Data

US 2024/0117515 A1 Apr. 11, 2024

(30) Foreign Application Priority Data

Sep. 15, 2022 (JP) ..... 2022-147391

(51) Int. Cl.
*C25B 15/08* (2006.01)
*C25B 1/04* (2021.01)
(Continued)

(52) U.S. Cl.
CPC ..... *C25B 15/083* (2021.01); *C25B 1/04* (2013.01); *C25B 1/23* (2021.01); *C25B 3/26* (2021.01); *C25B 9/23* (2021.01)

(58) Field of Classification Search
None
See application file for complete search history.

(56) References Cited

U.S. PATENT DOCUMENTS 10,883,180 B2 1/2021 Ono et al.
2007/0141439 A1* 6/2007 Vyas ..... H01M 8/0204 429/514
(Continued)

FOREIGN PATENT DOCUMENTS

CN 113348269 A 9/2021
JP 2001-342587 A 12/2001
(Continued)

OTHER PUBLICATIONS

Sinchao MA et al., "Efficient Electrochemical Flow System with Improved Anode for the Conversion of CO2 to CO", Journal of The Electrochemical Society, Aug. 6, 2014, vol. 161, No. 10, pp. F1124-F1131.
(Continued)

*Primary Examiner* — Louis J Rufo
(74) *Attorney, Agent, or Firm* — Foley & Lardner LLP

(57) ABSTRACT

An electrolytic device includes: an electrolysis cell including: an anode; a cathode; a first flow path plate facing on the anode, the first flow path plate having a first recess defining an anode flow path through which a first liquid flows; a second flow path plate facing on the cathode, the second flow path plate having a second recess defining a cathode flow path through which a first gas flows; and a separator provided between the anode and the cathode. The second flow path plate has an uneven surface on an inner surface of the second recess. An arithmetic mean roughness of the uneven surface is 0.03 μm or more and 50 μm or less.

18 Claims, 13 Drawing Sheets

(51) Int. Cl.

| | |
|---|---|
| ***C25B 1/23*** | (2021.01) |
| ***C25B 3/26*** | (2021.01) |
| ***C25B 9/23*** | (2021.01) |

(56) References Cited

U.S. PATENT DOCUMENTS

| | | | | |
|---|---|---|---|---|
| 2018/0265440 | A1* | 9/2018 | Kudo | C25B 9/19 |
| 2018/0274114 | A1 | 9/2018 | Ono et al. | |
| 2019/0221865 | A1 | 7/2019 | Gambini et al. | |
| 2020/0002821 | A1 | 1/2020 | Ono et al. | |
| 2020/0002822 | A1 | 1/2020 | Ono et al. | |
| 2020/0102662 | A1 | 4/2020 | Funakawa et al. | |
| 2022/0085390 | A1 | 3/2022 | Buechi et al. | |
| 2022/0178034 | A1 | 6/2022 | Erman et al. | |
| 2023/0008403 | A1 | 1/2023 | Erman et al. | |

FOREIGN PATENT DOCUMENTS

| | | | |
|---|---|---|---|
| JP | 2003-338296 | A | 11/2003 |
| JP | 2018-127707 | A | 8/2018 |
| JP | 2018-159130 | A | 10/2018 |
| JP | 2019-056136 | A | 4/2019 |
| JP | 2019-167556 | A | 10/2019 |
| JP | 2019-167557 | A | 10/2019 |
| JP | 2021-511630 | A | 5/2021 |
| JP | 7102599 | B1 | 7/2022 |
| WO | WO-2021/117311 | A1 | 6/2021 |

OTHER PUBLICATIONS

Zengcai Liu et al., "Electrochemical generation of syngas from water and carbon dioxide at industrially important rates", Journal of CO2 Utilization, Apr. 27, 2016, vol. 15, pp. 50-56.

Partial European Search Report for EP Application No. 23158989.6 dated Aug. 8, 2024 (16 pages).

JP Office Action for Japanese Patent Application No. 2022-147391 dated Jul. 1, 2025 (8 pages).

* cited by examiner

ELECTROLYTIC DEVICE

CROSS-REFERENCE TO RELATED APPLICATIONS

This application is based upon and claims the benefit of priority from Japanese Patent Applications No. 2022-147391, filed on Sep. 15, 2022; the entire contents of which are incorporated herein by reference.

FIELD

Embodiments relate to an electrolytic device.

BACKGROUND

Lately, there has recently been a concern about the depletion of fossil fuel such as petroleum and coal, and expectations are increasing for sustainable renewable energy. Examples of the renewable energy include those by a solar battery and wind power generation. The amount of power generated by these depends on weather and nature conditions, and thus they have a problem of difficulty in stably supplying the power. Therefore, it has been attempted to store, in a storage battery, the power generated from the renewable energy, so as to stabilize the power. Storing the power has problems of the cost of the storage battery and the occurrence of loss during the power storage.

In response to this point, attention has been focused on a technique that uses power generated from renewable energy to perform water electrolysis to produce hydrogen ($H_2$) from the water or electrochemically reduces carbon dioxide ($CO_2$) to convert it into a chemical substance (chemical energy) such as a carbon compound such as carbon monoxide (CO), formic acid (HCOOH), methanol ($CH_3OH$), methane ($CH_4$), acetic acid ($CH_3COOH$), ethanol ($C_2H_5OH$), ethane ($C_2H_6$), or ethylene ($C_2H_4$). Storing these chemical substances in a cylinder or a tank has advantages of being lower in energy storage cost and smaller in storage loss than storing the power (electric energy) in the storage battery.

As an electrolytic device, there has been considered a structure in which an Ag nanoparticle catalyst is used for a cathode, a cathode solution and a $CO_2$ gas are made in contact with the cathode, and an anode solution is made in contact with an anode, for example. As a specific configuration of the electrolytic device, there is cited a configuration including: a cathode solution flow path arranged along one surface of the cathode, a $CO_2$ gas flow path arranged along the other surface of the cathode, an anode solution flow path arranged along one surface of the anode, and a separator arranged between the cathode solution flow path and the anode solution flow path, for example. When a reaction to produce, for example, CO from $CO_2$ is performed for a long period of time by using the electrolytic device having such a configuration and making a constant current flow through the cathode and the anode, for example, there are problems of deterioration of cell performance over time, such as a decrease in a production amount of CO and an increase in cell voltage. Therefore, there is a need for a carbon dioxide electrolytic device capable of inhibiting the deterioration of cell performance over time.

DETAILED DESCRIPTION

Figure 1:
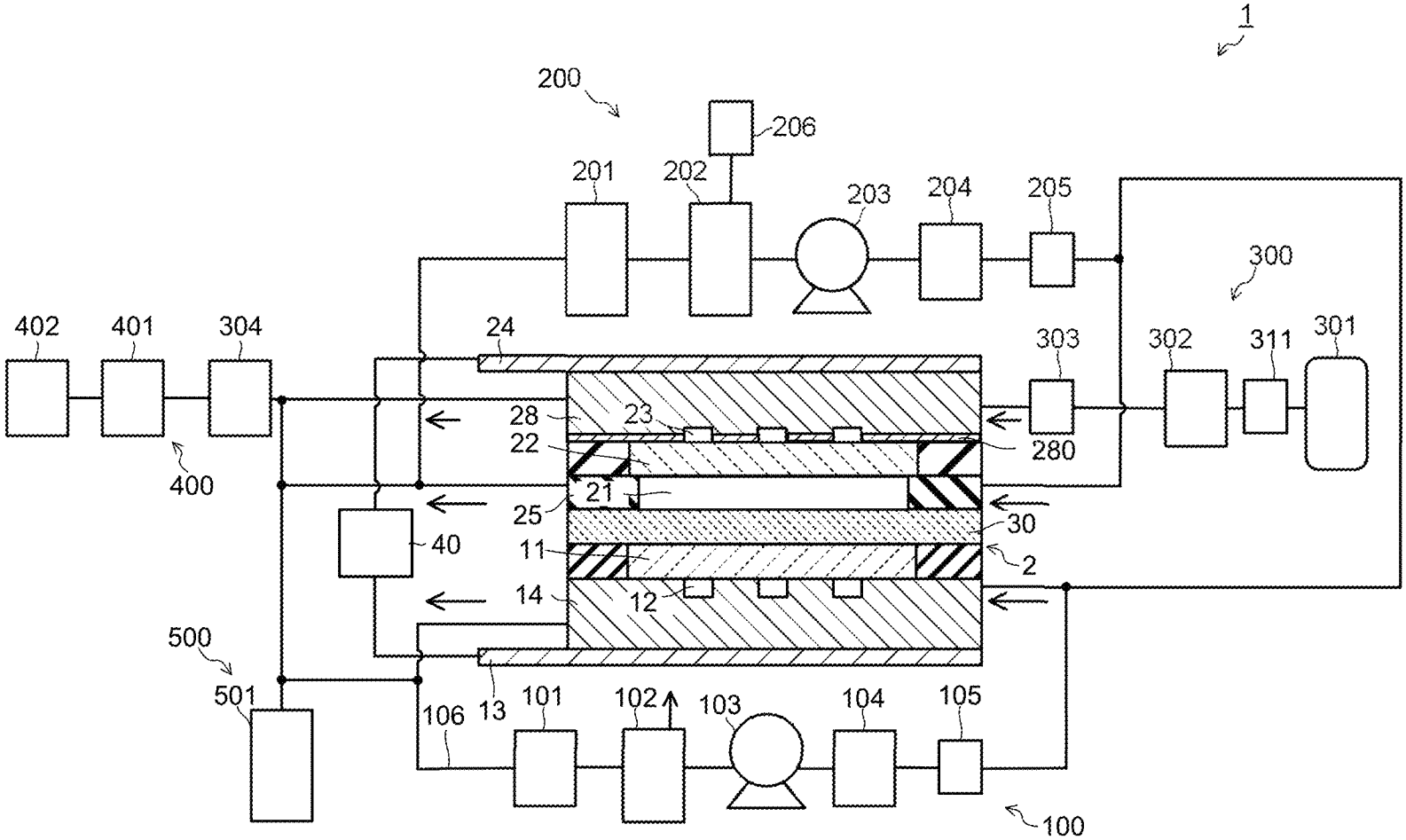
FIG. 1 is a diagram illustrating a configuration example of an electrolytic device.

An electrolytic device in an embodiment includes: an electrolysis cell including: an anode; a cathode; a first flow path plate facing on the anode, the first flow path plate having a first recess defining an anode flow path through which a first liquid flows; a second flow path plate facing on the cathode, the second flow path plate having a second recess defining a cathode flow path through which a first gas flows; and a separator provided between the anode and the cathode. The second flow path plate has an uneven surface on an inner surface of the second recess. An arithmetic mean roughness of the uneven surface is 0.03 μm or more and 50 μm or less.

Hereinafter, there will be explained an embodiment with reference to the drawings. In the embodiment, substantially the same components are denoted by the same reference numerals, and a description thereof may be partly omitted. The drawings are schematic, and a relation between thickness and planar dimension, a thickness ratio among parts, and so on may be different from actual ones.

In this specification, "connection" includes not only direct connection but also indirect connection, unless otherwise specified.

FIG. 1 is a diagram illustrating a configuration example of an electrolytic device. An electrolytic device 1 illustrated in FIG. 1 includes an electrolysis cell 2, an anode solution supply system 100, a cathode solution supply system 200, a cathode gas supply system 300, a product collection system 400, a waste liquid collection system 500, and an anode solution adjustment system 600.

Figure 2:
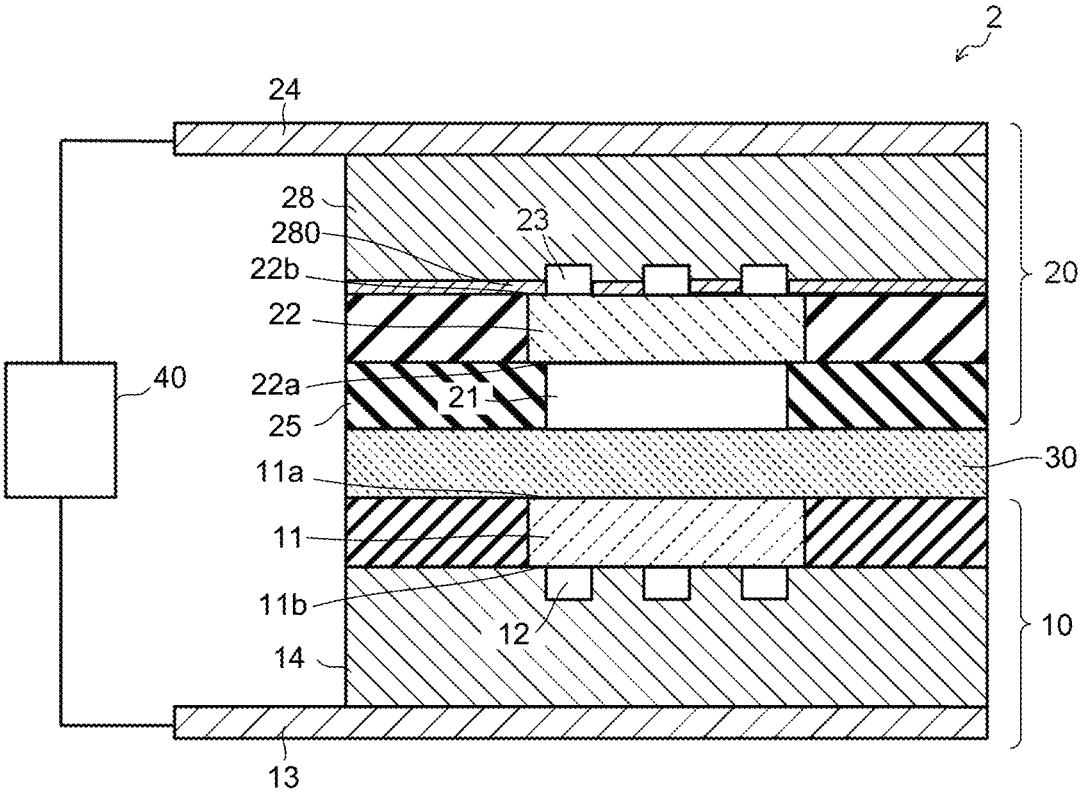
FIG. 2 is a cross-sectional view illustrating an electrolysis cell of the electrolytic device illustrated in FIG. 1.

FIG. 2 is a cross-sectional view illustrating a configuration of the electrolysis cell in the electrolytic device illustrated in FIG. 1. The electrolysis cell 2 includes an anode part 10, a cathode part 20, and a separator 30, as illustrated in FIG. 2.

The anode part 10 includes an anode 11, an anode flow path 12, and an anode current collector plate 13.

The cathode part 20 includes a cathode flow path 21, a cathode 22, a cathode flow path 23, and a cathode current collector plate 24. The cathode flow path 21 does not need to be provided.

The separator 30 is provided between the anode 11 and the cathode 22 and arranged so as to separate the anode part 10 and the cathode part 20.

The anode 11, the anode flow path 12, the anode current collector plate 13, the cathode flow path 21, the cathode 22, the cathode flow path 23, the cathode current collector plate 24, and the separator 30 may be stacked on top of each other. The electrolysis cell 2 is sandwiched between a pair of not-illustrated support plates and tightened with bolts or the like.

The anode 11 and the cathode 22 are connected to a power supply control part 40 via a current introduction member. The power supply control part 40 is not limited to a normal system power supply or a power source such as a battery, and may include a power source that supplies power generated by renewable energy such as a solar battery or wind power generation. The power supply control part 40 may include the above-described power source, a power controller that adjusts the output of the above-described power source to control the voltage between the anode 11 and the cathode 22, and so on.

The anode 11 is provided to oxidize a substance to be oxidized to produce an oxidation product. The anode 11 is an electrode (oxidation electrode) that causes an oxidation reaction of water ($H_2O$) in an anode solution as an electrolytic solution to produce oxygen ($O_2$) and hydrogen ions ($H^+$), or causes an oxidation reaction of hydroxide ions ($OH^-$) produced in the cathode part 20 to produce oxygen ($O_2$) and water ($H_2O$), for example. The anode 11 has a first surface 11*a* in contact with the separator 30 and a second surface 11*b* facing the anode flow path 12. The first surface 11*a* of the anode 11 is in close contact with the separator 30. The anode flow path 12 faces the anode 11 and supplies an anode solution to the anode 11 as an electrolytic solution, and is formed of a pit (groove/recess) provided in the flow path plate 14 (anode flow path plate). The anode solution flows through the anode flow path 12 so as to be in contact with the anode 11. The anode current collector plate 13 is in electrical contact with the surface of the flow path plate 14, which forms the anode flow path 12, opposite to the anode 11.

Figure 3:
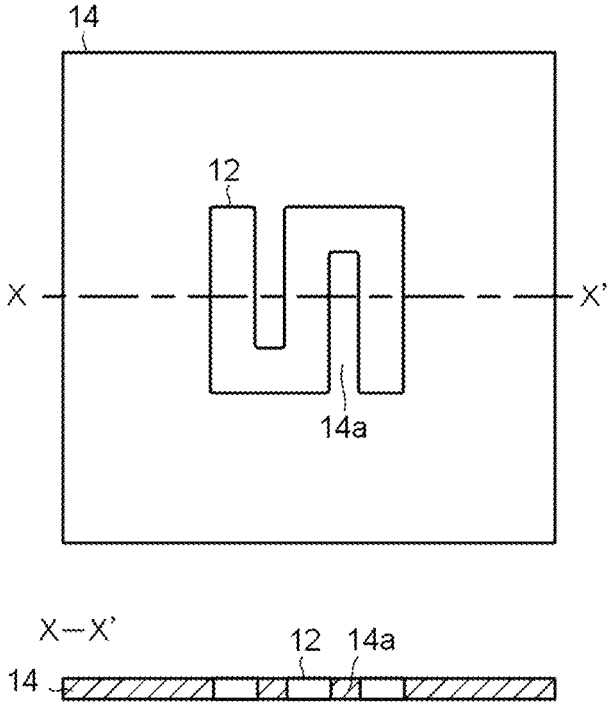
FIG. 3 is a view illustrating one example of an anode solution flow path in the electrolysis cell illustrated in FIG. 2.

The flow path plate 14 has a solution inlet port and a solution outlet port, which are not illustrated. The flow path plate 14 has the anode solution introduced and discharged by the anode solution supply system 100 through the solution inlet port and the solution outlet port. For the flow path plate 14, it is preferable to use a material having low chemical reactivity and high conductivity. Examples of such a material include metal materials such as Ti and SUS, carbon, and so on. As illustrated in FIG. 3, the anode flow path 12 is preferably provided with a plurality of lands (projections) 14*a*. The lands 14*a* are provided for mechanical retention and electrical continuity.

The anode 11 is preferably formed mainly of a catalyst material (anode catalyst material) capable of oxidizing water ($H_2O$) to produce oxygen and hydrogen ions, or oxidizing hydroxide ions ($OH^-$) to produce water and oxygen, and capable of reducing the overvoltage in such reactions. Examples of such a catalyst material include metals such as platinum (Pt), palladium (Pd), and nickel (Ni), alloys containing those metals, intermetallic compounds, binary metal oxides such as manganese oxide (Mn—O), iridium oxide (Ir—O), nickel oxide (Ni—O), cobalt oxide (Co—O), iron oxide (Fe—O), tin oxide (Sn—O), indium oxide (In—O), ruthenium oxide (Ru—O), lithium oxide (Li—O), and lanthanum oxide (La—O), ternary metal oxides such as Ni—Co—O, Ni—Fe—O, La—Co—O, Ni—La—O, and Sr—Fe—O, quaternary metal oxides such as Pb—Ru—Ir—O and La—Sr—Co—O, and metal complexes such as a Ru complex and a Fe complex.

The anode 11 includes a base material having a structure capable of making an anode solution or ions move between the separator 30 and the anode flow path 12, which is, for example, a porous structure such as a mesh material, a punching material, a porous body, or a metal fiber sintered body. The base material may be formed of a metal such as titanium (Ti), nickel (Ni), or iron (Fe), or a metal material such as an alloy containing at least one of these metals (for example, SUS), or may be formed of the above-described anode catalyst material. When an oxide is used as the anode catalyst material, it is preferable to form a catalyst layer by attaching or stacking the anode catalyst material to or on a surface of the base material formed of the above-described metal material. The anode catalyst material preferably has nanoparticles, a nanostructure, a nanowire, or the like for increasing the oxidation reaction. The nanostructure is a structure with nanoscale irregularities formed on the surface of the catalyst material.

The cathode 22 is provided to reduce a substance to be reduced to produce a reduction product. The cathode 22 is an electrode (reduction electrode) that produces carbon compounds such as carbon monoxide (CO), methane ($CH_4$), ethane ($C_2H_6$), ethylene ($C_2H_4$), methanol ($CH_3OH$), ethanol ($C_2H_5OH$), and ethylene glycol ($C_2H_6O_2$) by causing a reduction reaction of carbon dioxide ($CO_2$) and a reduction reaction of carbon compounds produced thereby, for example. At the cathode 22, a side reaction that generates hydrogen ($H_2$) from the reduction reaction of water ($H_2O$) may occur simultaneously with the reduction reaction of carbon dioxide ($CO_2$). The cathode 22 has a first surface 22*a* facing the cathode flow path 21 and a second surface 22*b* facing the cathode flow path 23. The cathode flow path 21 is arranged between the cathode 22 and the separator 30 so that a cathode solution as the electrolytic solution comes into contact with the cathode 22 and the separator 30.

The cathode flow path 21 faces the cathode 22 and is formed of a recess provided in the flow path plate 25 (cathode flow path plate). The flow path plate 25 is provided with a solution inlet port (simply referred to as an inlet) and a solution outlet port (simply referred to as an outlet), which are not illustrated, and through these solution inlet port and solution outlet port, the cathode solution is introduced and discharged as the electrolytic solution by the cathode solution supply system 200. The cathode solution flows through the cathode flow path 21 so as to be in contact with the cathode 22 and the separator 30. For the flow path plate 25 forming the cathode flow path 21, it is preferable to use a material having low chemical reactivity and no conductivity. Examples of such a material include insulating resin materials such as an acrylic resin, polyether ether ketone (PEEK), and a fluorocarbon resin. The cathode flow path 21 does not have to be provided because it leads to an increase in cell resistance.

Figure 4:
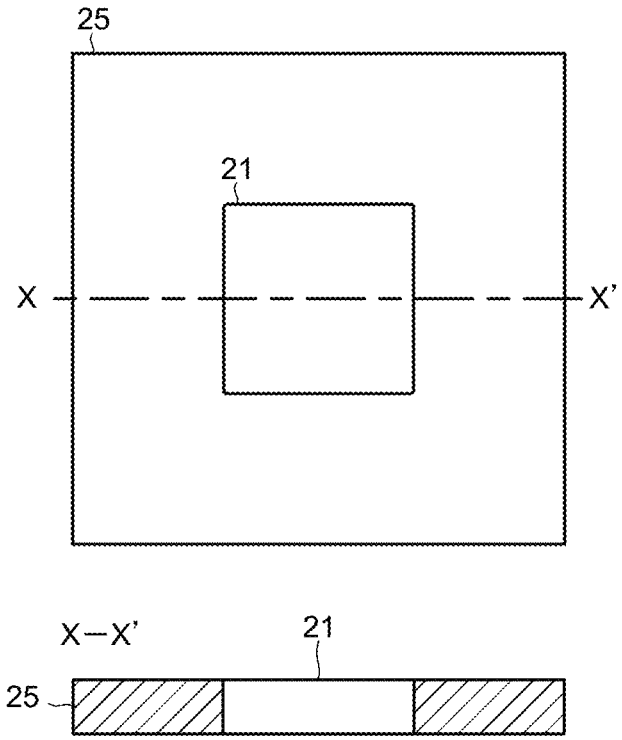
FIG. 4 is a view illustrating one example of a cathode solution flow path in the electrolysis cell illustrated in FIG. 2.
Figure 5:
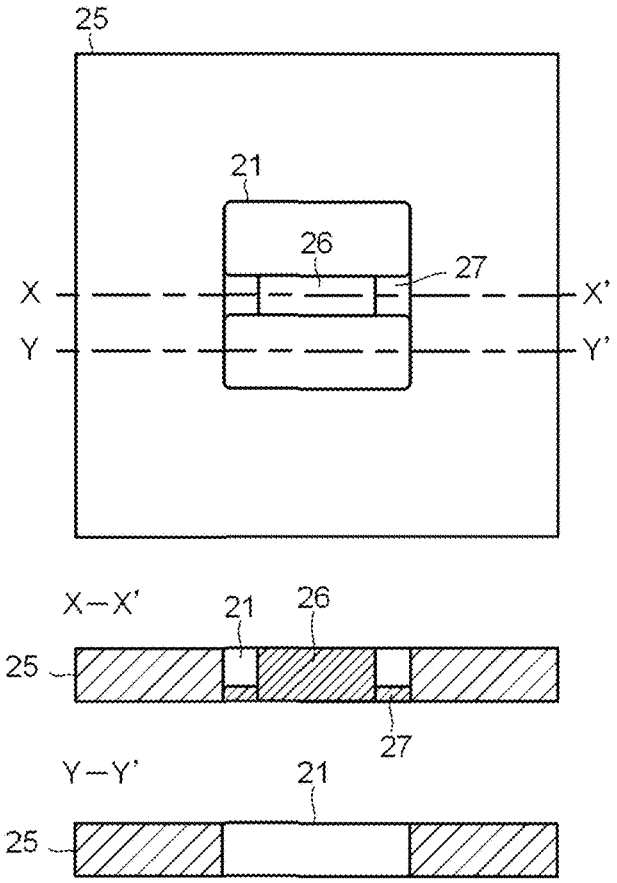
FIG. 5 is a view illustrating another example of the cathode solution flow path in the electrolysis cell illustrated in FIG. 2.

At the cathode 22, a reduction reaction occurs mainly at the portion in contact with the cathode solution. Therefore, as illustrated in FIG. 4, it is preferable to apply an opening having a large opening area to the cathode flow path 21. However, in order to improve mechanical retention and electrical connectivity, a land (projection) 26 may be provided in the cathode flow path 21 as illustrated in FIG. 5. The land 26 in the cathode flow path 21 is provided at the center of the cathode flow path 21 and is held to the flow path plate 25 with a bridge portion 27 that is thinner than the land 26 so as not to prevent the flow of the cathode solution in the cathode flow path 21. When the land 26 is provided in the cathode flow path 21, the number of lands 26 is preferably as small as possible in order to reduce the cell resistance.

At least a part of the land 26 is preferably superimposed on the land 14*a* of the flow path plate 14. This makes it possible to make a good electrical connection and reduce the electrical resistance of the electrolysis cell 2. Further, a good contact between the separator 30 and the anode and cathode catalyst materials can be made, thereby making it possible not only to reduce the electrical resistance, but also to perform the reaction efficiently. Further, at least a part of the anode flow path 12 is preferably superimposed on the land 26. This makes it possible to make a good electrical connection and reduce the electrical resistance of the electrolysis cell 2. Further, a good contact between the separator 30 and the anode and cathode catalyst materials can be made, thereby making it possible not only to reduce the electrical resistance, but also to perform the reaction efficiently.

The cathode flow path 23 faces the cathode 22 and is formed of a pit (groove/recess) provided in a flow path plate (cathode flow path plate) 28. For the flow path plate 28 forming a $CO_2$ gas flow path through which a gas containing carbon dioxide flows, it is preferable to use a material having low chemical reactivity and high conductivity. Examples of such a material include metal materials such as Ti and SUS, carbon, and so on. The flow path plate 14, the flow path plate 25, and the flow path plate 28 each are provided with an inlet port and an outlet port for a solution and gas, which are not illustrated, as well as screw holes for tightening, or the like. Further, a not-illustrated packing is sandwiched at the front and the back of each of the flow path plates 14, 25, and 28 as necessary.

Figure 6:
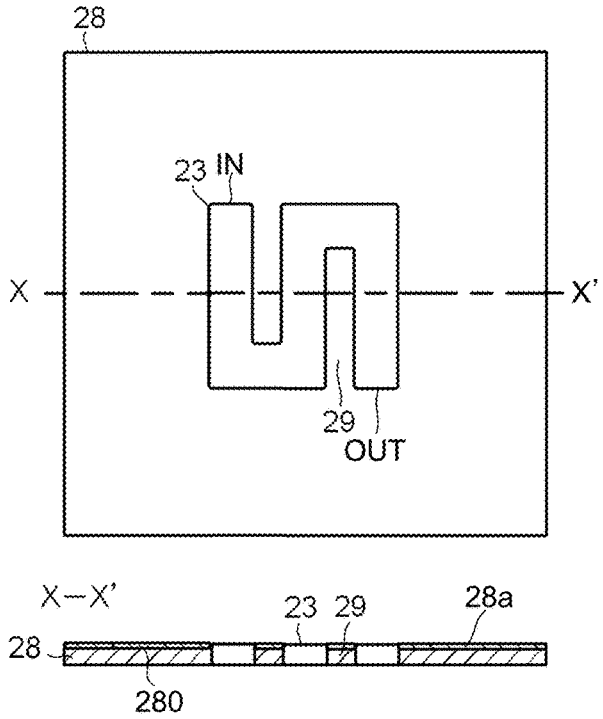
FIG. 6 is a view illustrating one example of a cathode flow path in the electrolysis cell illustrated in FIG. 2.

The flow path plate 28 is provided with a gas inlet port and a gas outlet port, which are not illustrated, and a $CO_2$ gas or gas containing $CO_2$ (sometimes simply referred to as $CO_2$ gas collectively) is introduced and discharged by the cathode gas supply system 300 through these gas inlet port and gas outlet port. The $CO_2$ gas flows through the cathode flow path 23 to come into contact with the cathode 22. A plurality of lands (projections) 29 are preferably provided in the cathode flow path 23, as illustrated in FIG. 6. The lands 29 are provided for mechanical retention and electrical continuity. The lands 29 are preferably provided alternately, and thereby, the cathode flow path 23 meanders in the same manner as the anode flow path 12. The cathode current collector plate 24 is in electrical contact with a surface of the flow path plate 28 opposite to the cathode 22.

In the electrolysis cell 2 in the embodiment, it is possible to increase a contact area between the anode 11 and the flow path plate 14 forming the anode flow path 12 and a contact area between the cathode 22 and the flow path plate 28 forming the cathode flow path 23 by providing the lands 14*a* and 29 in the anode flow path 12 and the cathode flow path 23. Further, it is possible to increase a contact area between the cathode 22 and the flow path plate 25 forming the cathode flow path 21 by providing the land 26 in the cathode flow path 21. Thereby, while improving the mechanical retention of the electrolysis cell 2, electrical continuity between the anode current collector plate 13 and the cathode current collector plate 24 is improved, which makes it possible to improve the $CO_2$ reduction reaction efficiency, or the like.

As illustrated in FIG. 6, a hydrophilic region 280 may be formed on at least a portion of a surface 28*a* of the flow path plate 28. The hydrophilic region 280 is a region having a lower contact angle with water, for example, than the other region of the surface 28*a*. This allows water to move from a second half to a first half of the cathode flow path 23 having a large amount of moisture. In other words, the water condensed in the second half of the cathode flow path 23, the water that has moved from the anode 11, and the water produced by the reaction can be moved to the flow path plate in the hydrophilic region 280. Therefore, in the first half of the cathode flow path 23, the water that has moved via the hydrophilic region 280 is evaporated by the temperature of the cell, and the gas in the cathode flow path 23 is humidified. As above, providing the hydrophilic region 280 makes it possible to improve uniformity of the humidity in the cathode flow path 23, and humidification can be performed inside the cell without providing a humidifier. The hydrophilic region 280 has a contact angle with water of 0 degrees or more and less than degrees. The above-described contact angle is preferably 30 degrees or less and further preferably 15 degrees or less. The hydrophilic region 280 may be impermeable to gases such as carbon dioxide. The hydrophilic region 280 does not necessarily have to be provided.

The hydrophilic region 280 can be formed, for example, by roughening the surface 28*a* with carbon particles or the like attached thereto, by coating the surface 28*a* with a hydrophilic conductive polymer such as polyacetylene, polythiophene, polyaniline, or polypyrrole, or by forming the flow path plate 28 with a hydrophilic material.

Figure 7:
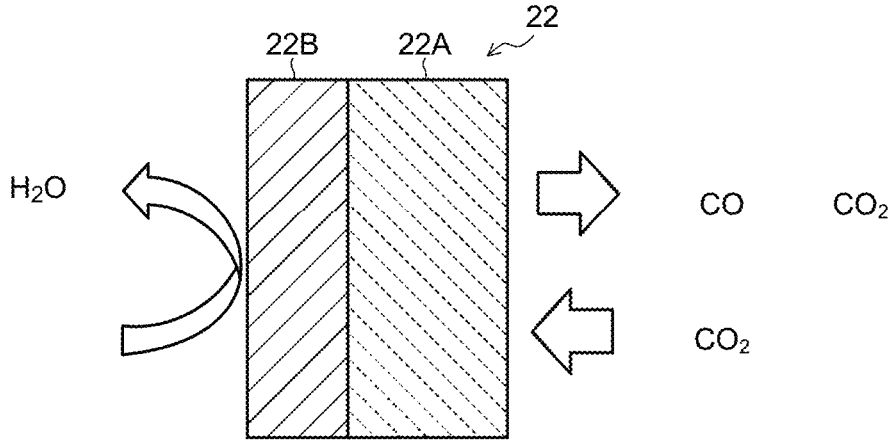
FIG. 7 is a view illustrating one example of a cathode in the electrolysis cell illustrated in FIG. 2.
Figure 8:
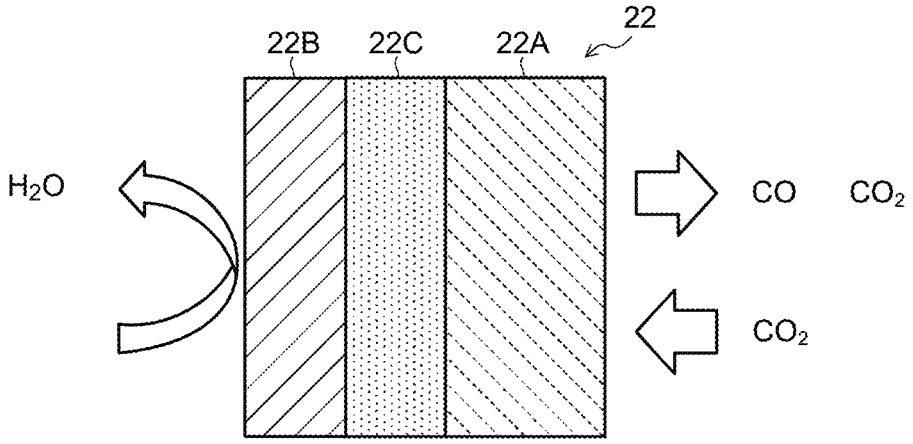
FIG. 8 is a view illustrating another example of the cathode in the electrolysis cell illustrated in FIG. 2.
Figure 9:
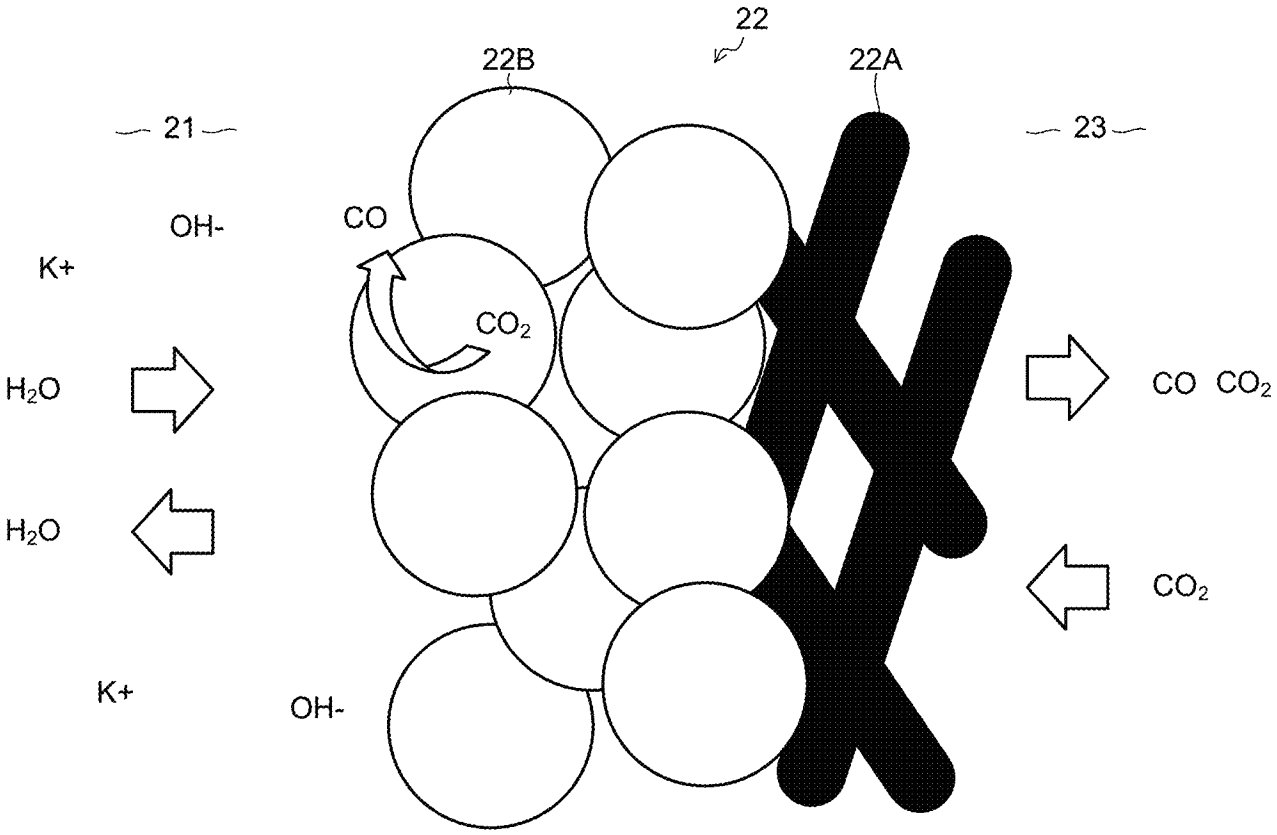
FIG. 9 is a view schematically illustrating a reaction in the cathode in the electrolysis cell illustrated in FIG. 2.

As illustrated in FIG. 7, the cathode 22 includes a gas diffusion layer 22A and a cathode catalyst layer 22B provided thereon. Between the gas diffusion layer 22A and the cathode catalyst layer 22B, a porous layer 22C denser than the gas diffusion layer 22A may be arranged as illustrated in FIG. 8. As illustrated in FIG. 9, the gas diffusion layer 22A is arranged on the cathode flow path 23 side, and the cathode catalyst layer 22B is arranged on the cathode flow path 21 side. The cathode catalyst layer 22B may enter the gas diffusion layer 22A. The cathode catalyst layer 22B preferably has catalyst nanoparticles, a catalyst nanostructure, or the like. The gas diffusion layer 22A is formed of, for example, carbon paper, carbon cloth, or the like, and has been subjected to a water repellent treatment. The porous layer 22C is formed of a porous body with a smaller pore size than the carbon paper or carbon cloth.

As illustrated in the schematic view in FIG. 9, the cathode solution and ions are supplied and discharged from the cathode flow path 21 in the cathode catalyst layer 22B. In the gas diffusion layer 22A, a cathode gas is supplied, and products of the reduction reaction of the cathode gas are discharged from the cathode flow path 23. With the application of a moderate water repellent treatment to the gas diffusion layer 22A, the cathode gas reaches the cathode catalyst layer 22B mainly by gas diffusion. The reduction reaction of $CO_2$ and the reduction reaction of the carbon compound produced by the reduction reaction occur near the boundary between the gas diffusion layer 22A and the cathode catalyst layer 22B, or near the cathode catalyst layer 22B that has entered the gas diffusion layer 22A. Gaseous products are mainly discharged from the cathode flow path 23, while liquid products are mainly discharged from the cathode flow path 21.

The cathode catalyst layer 22B is preferably formed of a catalyst material (cathode catalyst material) capable of reducing carbon dioxide to produce carbon compounds or capable of reducing the produced carbon compounds to produce carbon compounds as necessary, and capable of reducing an overvoltage in such reactions. Examples of such a material include metals such as gold (Au), silver (Ag), copper (Cu), platinum (Pt), palladium (Pd), nickel (Ni), cobalt (Co), iron (Fe), manganese (Mn), titanium (Ti), cadmium (Cd), zinc (Zn), indium (In), gallium (Ga), lead (Pb), and tin (Sn), metal materials such as alloys containing at least one of these metals and intermetallic compounds, carbon materials such as carbon (C), graphene, CNT (carbon nanotube), fullerene, and ketjen black, and metal complexes such as a Ru complex and a Re complex. The cathode catalyst layer 22B can employ various shapes such as a plate shape, a mesh shape, a wire shape, a particle shape, a porous shape, a thin film shape, and an island shape.

The cathode catalyst layer 22B may use a cathode catalyst material capable of reducing nitrogen to produce ammonia. Examples of such a material include molybdenum complexes. Examples of the molybdenum complex include molybdenum complexes (A) to (D) described below.

A first example includes (A) a molybdenum complex having N,N-bis(dialkylphosphinomethyl)dihydrobenzimidazolidene (where two alkyl groups may be the same or different and at least one hydrogen atom of the benzene ring may be substituted with an alkyl group, an alkoxy group, or a halogen atom) as a PCP ligand.

A second example includes (B) a molybdenum complex having 2,6-bis(dialkylphosphinomethyl)pyridine (where two alkyl groups may be the same or different and at least one hydrogen atom of the pyridine ring may be substituted with an alkyl group, an alkoxy group, or a halogen atom) as a PNP ligand.

A third example includes (C) a molybdenum complex having bis(dialkylphosphinomethyl)arylphosphine (where two alkyl groups may be the same or different) as a PPP ligand.

A fourth example includes (D) a molybdenum complex expressed by trans-$Mo(N_2)_2(RIR2R3P)_4$ (where R1, R2, R3 are alkyl groups or aryl groups that may be the same or different, and two R3s may couple with each other to form an alkylene chain).

In the above molybdenum complexes, the alkyl group may be, for example, a methyl group, an ethyl group, a propyl group, a butyl group, a pentyl group, a hexyl group, or a straight-chain or branched-chain alkyl group of their structural isomers, or a cyclic alkyl group such as a cyclopropyl group, a cyclobutyl group, a cyclopentyl group, or a cyclohexyl group. The carbon number of the alkyl group is preferably 1 to 12, and more preferably 1 to 6. The alkoxy group may be, for example, a methoxy group, an ethoxy group, a propoxy group, a butoxy group, a pentoxy group, a hexyloxy, or a straight-chain or branched-chain alkoxy group of their structural isomers, or a cyclic alkoxy group such as a cyclopropoxy group, a cyclobutoxy group, a cyclopentoxy group, or a cyclohexyloxy group. The carbon number of the alkoxy group is preferably 1 to 12, and more preferably 1 to 6. Examples of the halogen atom include a fluorine atom, a chlorine atom, a bromine atom, an iodine atom, and so on.

The molybdenum complex of (A) includes a molybdenum complex expressed, for example, by the following Formula (A1).

[Chemical formula 1]

(A1)

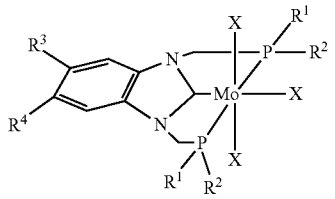

(in the formula, R1 and R2 are alkyl groups that may be the same or different, and X is an iodine atom, a bromine atom, or a chlorine atom, and at least one hydrogen atom on the benzene ring may be substituted with an alkyl group, an alkoxy group, or a halogen atom)

Examples of the alkyl group, the alkoxy group, and the halogen atom include the same as those already exemplified. R1 and R2 are each preferably a bulky alkyl group (for example, a tert-butyl group or an isopropyl group). It is preferable that the hydrogen atom on the benzene ring is not substituted, or the 5-position and 6-position hydrogen atoms are substituted with 1-12C chain, cyclic, or branched alkyl groups. Examples of the molybdenum complex of (B) include molybdenum complexes expressed, for example, by the following Formula (B1), Formula (B2), and Formula (B3).

[Chemical formula 2]

(B1)

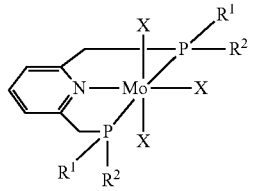

(B2)

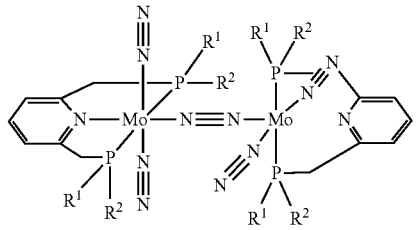

(B3)

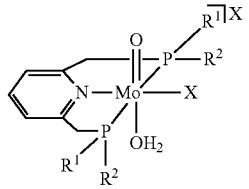

(in the formulas, R1 and R2 are alkyl groups that may be the same or different, and X is an iodine atom, a bromine atom, or a chlorine atom, and at least one hydrogen atom on the pyridine ring may be substituted with an alkyl group, an alkoxy group, or a halogen atom) Examples of the alkyl group, the alkoxy group, and the halogen atom include the same as those already exemplified. R1 and R2 are each preferably a bulky alkyl group (for example, a tert-butyl group or an isopropyl group). It is preferable that the hydrogen atom on the pyridine ring is not substituted, or the 4-position hydrogen atom is substituted with a 1-12C chain, cyclic, or branched alkyl group.

The molybdenum complex of (C) includes a molybdenum complex expressed, for example, by the following Formula (C1).

[Chemical formula 3]

(C1)

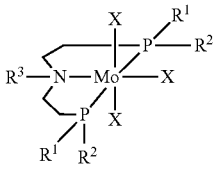

(in the formula, R1 and R2 are alkyl groups that may be the same or different, R3 is an aryl group, and X is an iodine atom, a bromine atom, or a chlorine atom)

Examples of the alkyl group include the same as those already exemplified. Examples of the aryl group include a phenyl group, a tolyl group, a xylyl group, a naphthyl group, and those each having at least one of cyclic hydrogen atoms substituted with an alkyl group or a halogen atom, and so on. Examples of the alkyl group and the halogen atom include the same as those already exemplified. R1 and R2 are each preferably a bulky alkyl group (for example, a tert-butyl group or an isopropyl group). R3 is preferably, for example, a phenyl group.

Examples of the molybdenum complex of (D) include molybdenum complexes expressed, for example, by the following Formula (D1) and Formula (D2).

[Chemical formula 4]

(D1)

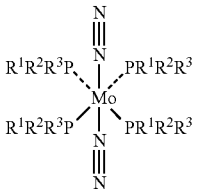

(D2)

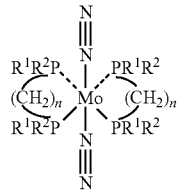

(in the formulas, R1, R2, and R3 are alkyl groups or aryl groups that may be the same or different, and n is 2 or 3)

Examples of the alkyl group and the aryl group include the same as those already exemplified. In Formula (D1), it is preferable that R1 and R2 are aryl groups (for example, phenyl groups) and R3 is a 1-4C alkyl group (for example, a methyl group) or that R1 and R2 are 1-4C alkyl groups (for example, methyl groups) and R3 is an aryl group (for example, a phenyl group). In Formula (D2), it is preferable that R1 and R2 are aryl groups (for example, phenyl groups) and n is 2.

The cathode catalyst material forming the cathode catalyst layer 22B preferably has nanoparticles of the above-described metal material, a nanostructure of the metal material, a nanowire of the metal material, or a composite body in which nanoparticles of the above-described metal material are supported on a carbon material such as carbon particles, a carbon nanotube, or graphene. Applying catalyst nanoparticles, a catalyst nanostructure, a catalyst nanowire, a catalyst nano-support structure, or the like as the cathode catalyst material makes it possible to increase the reaction efficiency of the reduction reaction of carbon dioxide at the cathode 22.

The separator 30 is provided between the anode 11 and the cathode 22. The separator 30 is formed of an ion exchange membrane capable of making ions move between the anode 11 and the cathode 22 and separating the anode part 10 and the cathode part 20, or the like. Examples of the ion exchange membrane include cation exchange membranes such as Nafion and Fremion, and anion exchange membranes such as Neosepta and Selemion. As described below, when an alkaline solution is used as the anode solution and the cathode solution and the move of hydroxide ions ($OH^-$) is assumed mainly, the separator 30 is preferably formed of the anion exchange membrane. However, besides the ion exchange membrane, a glass filter, a porous polymer membrane, a porous insulating material, or the like may be applied to the separator 30 as long as the material is capable of making ions move between the anode 11 and the cathode 22.

The anode solution and the cathode solution as the electrolytic solution each preferably are a solution containing at least water ($H_2O$). Since carbon dioxide ($CO_2$) or nitrogen ($N_2$) is supplied from the cathode flow path 23, the cathode solution may contain carbon dioxide ($CO_2$) or nitrogen ($N_2$), or does not have to contain it. The same solution may be used for the anode solution and the cathode solution, or different solutions may be used for them. Examples of the $H_2O$-containing solution used as the anode solution and the cathode solution include an aqueous solution containing an optional electrolyte. Examples of the electrolyte-containing aqueous solution include an aqueous solution containing at least one selected from hydroxide ions ($OH^-$), hydrogen ions ($H^+$), potassium ions ($K^+$), sodium ions ($Na^+$), lithium ions ($Li^+$), chloride ions ($Cl^-$), bromide ions ($Br^-$), iodide ions ($I^-$), nitrate ions ($NO_3^-$), sulfate ions ($SO_4^{2-}$), phosphate ions ($PO_4^{2-}$), borate ions ($BO_3^{3-}$), and hydrogen carbonate ions ($HCO_3^-$). In order to reduce the electrical resistance of the electrolytic solution, an alkali solution in which an electrolyte such as potassium hydroxide or sodium hydroxide is dissolved with a high concentration is preferably used as the anode solution and the cathode solution.

As the cathode solution, there may be used an ionic liquid that is made of salt of cations such as imidazolium ions or pyridinium ions and anions such as $BF_4^-$ or $PF_6^-$ and is in a liquid state in a wide temperature range, or its aqueous solution may be used. Other examples of the cathode solution include solutions of amines such as ethanolamine, imidazole, and pyridine and their aqueous solutions. The amine may be any of primary amine, secondary amine, and tertiary amine.

The anode solution supply system 100 supplies the anode solution to the anode flow path 12 as the electrolytic solution. The anode solution supply system 100 includes a pressure control part 101, an anode solution tank 102, a flow rate control part (pump) 103, a reference electrode 104, and a pressure gauge 105, and is configured to circulate the anode solution through the anode flow path 12. The anode solution supply system 100 connects the inlet and the outlet of the anode flow path 12 via a flow path 106. The anode solution supply system 100 circulates the anode solution so that the anode solution flows through the anode flow path 12. The anode solution tank 102 accommodates a fluid containing the anode solution discharged from the outlet of the anode flow path 12 (to be also referred to as an anode waste liquid) and is connected to a not-illustrated gas component collection part that collects gas components such as oxygen ($O_2$) contained in the circulating anode solution. The anode solution is introduced into the anode flow path 12 after its flow rate and pressure are controlled in the pressure control part 101 and the flow rate control part 103.

The cathode solution supply system 200 supplies the cathode solution to the cathode flow path 21. The cathode solution supply system 200 circulates the cathode solution so that the cathode solution flows through the cathode flow path 21. The cathode solution supply system 200 includes a pressure control part 201, a cathode solution tank 202, a flow rate control part (pump) 203, a reference electrode 204, and a pressure gauge 205, and is configured to circulate the cathode solution through the cathode flow path 21. The cathode solution tank 202 is connected to a gas component collection part 206 that collects gas components of reduction products such as carbon monoxide (CO) contained in the circulating cathode solution. The cathode solution is introduced into the cathode flow path 21 after its flow rate and pressure are controlled in the pressure control part 201 and the flow rate control part 203.

The cathode gas supply system 300 supplies the cathode gas to the cathode flow path 23. The cathode gas supply system 300 includes a cathode gas supply source 301, a humidifier 311, a flow rate control part 302, a pressure gauge 303, and a pressure control part 304. The cathode gas is introduced into the cathode flow path 23 after its flow rate and pressure are controlled in the flow rate control part 302 and the pressure control part 304.

The cathode gas supply source 301 is capable of supplying the cathode gas to the cathode flow path 23. In the case of a carbon dioxide electrolytic device, the cathode gas supply source 301 is capable of supplying a cathode gas containing a carbon dioxide gas to the cathode flow path 23. In the case of a nitrogen electrolytic device, the cathode gas supply source 301 is capable of supplying a cathode gas containing nitrogen to the cathode flow path 23. The cathode gas supply source 301 includes, for example, a tank configured to accommodate the cathode gas.

The humidifier 311 is capable of humidifying the cathode gas. The humidifier 311 includes, for example, a tank that accommodates warm water. As the cathode gas passes through the tank, the cathode gas containing water vapor can be supplied to the cathode flow path 23. The cathode gas supply system 300 does not necessarily include the humidifier 311.

The product collection system 400 is connected to the cathode gas supply system 300 and collects products in the gas that has flowed through the cathode flow path 23. The product collection system 400 includes a gas/liquid separation part 401 and a product collection part 402. Reduction products such as CO and $H_2$ contained in the fluid that has flowed through the cathode flow path 23 are accumulated in the product collection part 402 through the gas/liquid separation part 401.

The waste liquid collection system 500 includes a waste liquid collection tank 501 connected to the anode flow path 12 and the cathode flow path 21. The waste liquid of the anode solution or the cathode solution is collected in the waste liquid collection tank 501 by opening and closing a not-illustrated valve. The opening and closing of the valve and other operations may be collectively controlled by a not-illustrated control system. The waste liquid of the anode solution or the cathode solution may be returned to the anode solution supply system 100 or the cathode solution supply system 200.

Figure 10:
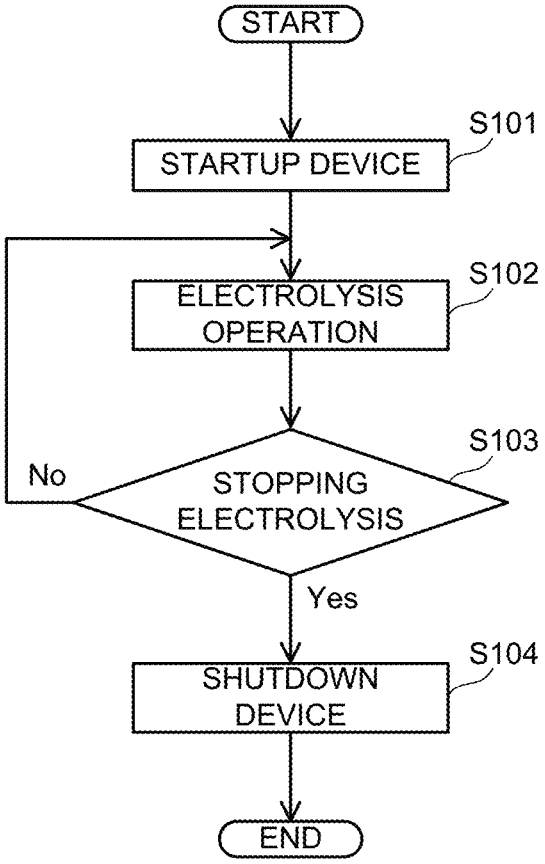
FIG. 10 is a view illustrating steps of operation of the electrolytic device.

There is explained an operating operation of the electrolytic device 1 in the embodiment. Here, there is explained an example where the electrolytic reaction of carbon dioxide is performed. First, as illustrated in FIG. 10, a startup step S101 of the electrolytic device 1 is performed.

At the startup step S101 of the electrolytic device 1, the following operations are performed. The anode solution supply system 100 introduces the anode solution into the anode flow path 12 after its flow rate and pressure are controlled in the pressure control part 101 and the flow rate control part 103. The cathode solution supply system 200 introduces the cathode solution into the cathode flow path 21 after its flow rate and pressure are controlled in the pressure control part 201 and the flow rate control part 203. The cathode gas supply system 300 introduces the cathode gas into the cathode flow path 23 after its flow rate and pressure are controlled in the flow rate control part 302 and the pressure control part 304.

Then, an electrolysis operation step S102 is performed. At the electrolysis operation step S102, application of a bath voltage by the power supply control part 40 in the electrolytic device 1 that has undergone the startup step S101 is started, and a current is supplied by applying a voltage between the anode 11 and cathode 22. When the current is applied between the anode 11 and cathode 22, an oxidation reaction near the anode 11 and a reduction reaction near the cathode 22 occur, which will be described below. Here, there is mainly explained the case when carbon monoxide (CO) is produced as the carbon compound. However, the carbon compound as the reduction product of carbon dioxide is not limited to carbon monoxide, but can be other carbon compounds such as the organic compounds described above. Further, as the reaction process by the electrolysis cell 2, the case of producing mainly hydrogen ions ($H^+$) and the case of producing mainly hydroxide ions ($OH^-$) are considered, but the reaction process is not limited to either of these reaction processes.

First, there is explained the reaction process in the case of mainly oxidizing water ($H_2O$) to produce hydrogen ions ($H^+$). When current is supplied from the power supply control part 40 between the anode 11 and cathode 22, the oxidation reaction of water ($H_2O$) occurs at the anode 11. Specifically, as illustrated in Expression (1) below, $H_2$ O contained in the anode solution is oxidized to produce oxygen ($O_2$) and hydrogen ions ($H^+$).

$$2H_2O \rightarrow 4H^+ + O_2 + 4e^- \quad (1)$$

$H^+$ produced at the anode 11 moves through the anode solution present in the anode 11, the separator 30, and the cathode solution in the cathode flow path 21 to reach near the cathode 22. Electrons ($e^-$) based on the current supplied to the cathode 22 from the power supply control part 40 and $H^+$ that has moved near the cathode 22 cause the reduction reaction of carbon dioxide ($CO_2$). Specifically, as illustrated in Equation (2) below, $CO_2$ supplied to the cathode 22 from the cathode flow path 23 is reduced to produce CO.

$$2CO_2+4H^++4e^-\rightarrow 2CO+2H_2O \quad (2)$$

Next, there is explained the reaction process in the case of mainly reducing carbon dioxide ($CO_2$) to produce hydroxide ions ($OH^-$). When current is supplied from the power supply control part 40 between the anode 11 and the cathode 22, water ($H_2O$) and carbon dioxide ($CO_2$) are reduced near the cathode 22 to produce carbon monoxide (CO) and hydroxide ions ($OH^-$), as illustrated in Expression (3) below. The hydroxide ions ($OH^-$) diffuse near the anode 11, and as illustrated in Expression (4) below, the hydroxide ions ($OH^-$) are oxidized to produce oxygen ($O_2$).

$$2CO_2+2H_2O+4e^-\rightarrow 2CO+4OH^- \quad (3)$$

$$4OH-\rightarrow 2H_2O+O2+4e^- \quad (4)$$

Further, when nitrogen of a substance to be reduced is reduced to produce ammonia ($NH_3$) of a reduction product, electrochemically water or hydroxide ions are oxidized near the anode 11 based on Expression (5) or (6) below to produce oxygen. Near the cathode 121, nitrogen is reduced based on Expression (7) or (8) below to produce ammonia.

$$3H_2O\rightarrow 3/2O_2+6H^++6e^- \quad (5)$$

$$6OH-\rightarrow 3/2O_2+3H_2O+6e^- \quad (6)$$

$$N_2+6H_2O+6e^-\rightarrow 2NH_3+6OH^- \quad (7)$$

$$N_2+6H^++6e^-\rightarrow 2NH_3 \quad (8)$$

Then, an electrolysis stop step S103 is performed. At the electrolysis stop step S103, it is determined whether or not to continue the electrolysis operation, and the application of the bath voltage by the power supply control part 40 in the electrolytic device 1 is stopped when stopping the electrolysis operation. The electrolysis operation is stopped when the electrolysis efficiency of the electrolysis cell 2 falls below a reference value, for example.

Then, at a shutdown step S104 of the electrolytic device 1, the following operations are performed. The anode solution supply system 100 controls the pressure control part 101 and the flow rate control part 103 to stop the introduction of the anode solution into the anode flow path 12. The cathode solution supply system 200 controls the pressure control part 201 and the flow rate control part 203 to stop the introduction of the cathode solution into the cathode flow path 21. The cathode gas supply system 300 controls the flow rate control part 302 and the pressure control part 304 to stop the introduction of the cathode gas into the cathode flow path 23.

In the electrolysis operation, when the cathode catalyst peels off from the cathode 22, it is discharged from the electrolysis cell 2 through the cathode flow path 23 and the amount of the cathode catalyst in the cathode 22 decreases, causing a decrease in the electrolysis efficiency, and the cell performance decreases.

Thus, in the electrolytic device in the embodiment, irregularities capable of trapping the cathode catalyst are formed on the surface 28*a*. The cathode catalyst trapped in the irregularities of the surface 28*a* is capable of causing a reduction reaction. Therefore, it is possible to inhibit the decrease in the cell performance.

Figure 11:
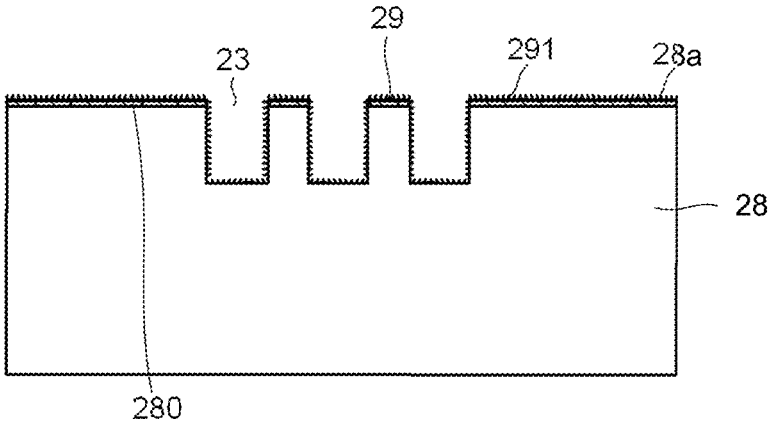
FIG. 11 is a schematic cross-sectional view illustrating a structure example of a flow path plate 28 having irregularities.
Figure 12:
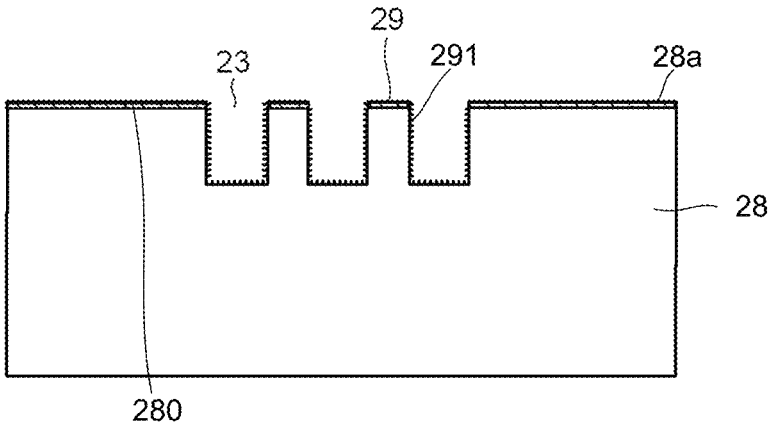
FIG. 12 is a schematic cross-sectional view illustrating a structure example of the flow path plate 28 having irregularities.

FIG. 11 and FIG. 12 each are a schematic cross-sectional view illustrating a structure example of the flow path plate 28 having irregularities. The surface 28*a* of the flow path plate 28 on the cathode 22 side has an uneven surface 291. The uneven surface 291 illustrated in FIG. 11 is provided on the entire surface 28*a* of the flow path plate 28.

Figure 13:
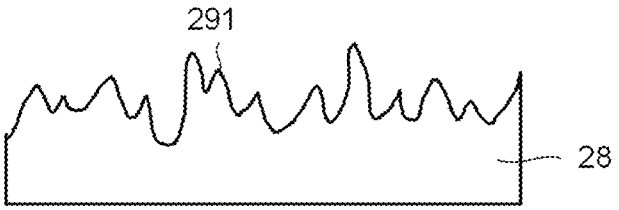
FIG. 13 is a schematic view illustrating an example of a shape of an uneven surface 291.

FIG. 13 is a schematic view illustrating an example of the shape of the uneven surface 291. FIG. 13 is an enlarged view of a part of the flow path plate 28 illustrated in FIG. 11. The surface roughness (width of each irregularity) of the uneven surface 291 is preferably 0.03 μm or more and 50 μm or less. Considering the particle diameter of the cathode catalyst, the surface roughness of 0.03 μm or more and 1 μm or less is suitable for trapping or adsorption of the cathode catalyst by the uneven surface 291. When the cathode catalyst is supported on a carrier, the surface roughness of the uneven surface 291 is preferably 0.03 μm or more, which is the particle diameter of the carrier, and the surface roughness of 50 μm or less, which is the diameter of an aggregate of the carrier, is suitable for trapping or adsorption of a catalyst carrier. In general, a smaller aggregate is better. The carrier aggregate having a particle diameter of 10 μm or less is preferred, so that the width of the irregularity is also preferably 10 μm or less. The surface roughness is preferably 0.05 μm or more, and more preferably 0.1 μm or more. The surface roughness is defined by a value measured by an analytical method using, for example, a laser microscope, Talystep, Surftest, or scanning electron microscope (SEM).

The average roughness (arithmetic mean roughness) of the uneven surface 291 is 10 nm or more and 30 μm or less, preferably 1 μm or more and 10 μm or less, and further preferably 3 μm or more and 10 μm or less. The maximum height of the hydrophilic region 280 is preferably 1 μm or more and 50 μm or less.

The uneven surface 291 may be provided on the entire flow path plate 28. This can also be achieved by the flow path plate 28 being formed of a porous body, for example. The average pore size of the porous body is preferably 0.1 μm or more and 10 μm or less. The porosity of the hydrophilic porous body is preferably 30% or more and 80% or less. The average pore size and the porosity of the porous body can be measured by an analytical method using, for example, a laser microscope, Talystep, Surftest, or the like.

The uneven surface 291 having the above-described surface roughness is formed, and thereby, the cathode catalyst or the carrier supporting the cathode catalyst can be trapped in the cathode flow path 23. When the cathode catalyst on the surface of the cathode 22 peels off, the amount of catalyst decreases, resulting in a decrease in the cell performance. Therefore, by trapping the cathode catalyst or the peeled material of the carrier supporting the cathode catalyst in the uneven surface 291, the reduction reaction occurs partially even on the cathode flow path 23, thereby making it possible to inhibit the decrease in the performance of the electrolysis cell 2.

By forming the uneven surface 291 on the cathode flow path 23, the precipitation of carbonates can be inhibited in the cathode flow path 23 even though, in the electrolysis operation, for example, a phenomenon occurs in which cations, which are an electrolytic solution component, react with a carbon dioxide gas to precipitate carbonates.

The uneven surface 291 may be provided only on a part of the surface 28*a* of the flow path plate 28. The uneven surface 291 illustrated in FIG. 12 is provided on the inner side surface and the inner bottom surface of the recess forming the cathode flow path 23 and is not provided on the land 29. The surface roughness of the portion of the surface 28*a* of the flow path plate 28 where the uneven surface 291 is not provided is smaller than that of the uneven surface 291.

As described above, the uneven surface 291 may be formed on the entire flow path plate 28 from the viewpoint of workability, but from the viewpoint of an increase in workload associated with working and cost, the uneven surface 291 may be formed only on the portion of the cathode flow path 23 in the flow path plate 28. Further, in the case of forming the uneven surface 291 on the entire flow path plate 28, when the size of irregularities of the uneven surface 291 is increased, the cathode gas permeates more easily via the land 29 that is in contact with the cathode catalyst, and the cathode gas does not flow along the cathode flow path 23, but flows by taking a shortcut on the cathode flow path 23, which is not preferable. Further, from the viewpoint of reactivity and trapping of the cathode catalyst, the uneven surface 291 may be provided only on the second half of the cathode flow path 23, or the surface roughness of the uneven surface 291 at the second half of the cathode flow path 23 may be varied. That is, the surface roughness of the second half of the cathode flow path 23 is preferably larger than that of the first half of the cathode flow path 23. This can promote the trapping of a cathode catalyst layer 292 or a carrier supporting the cathode catalyst layer 292 at the second half of the cathode flow path 23. The first half of the cathode flow path 23 is the portion closer to an inlet IN than an outlet OUT along the length direction of the cathode flow path 23. The second half of the cathode flow path 23 is the portion closer to the outlet OUT than the inlet IN along the length direction of the cathode flow path 23.

The uneven surface 291 can be formed by machining a metal plate for forming the flow path plate 28, for example. It is efficient and preferable to perform the machining at the same time as forming the irregularities by cutting. Further, the uneven surface 291 may be formed on the metal plate in press working by etching, or the like in advance, or the uneven surface 291 may be formed during press working. Alternatively, the uneven surface 291 can be formed by a method such as a method of making carbon particles or the like adhere to the surface and roughening the surface or a method in which the surface of the flow path plate 28 is coated with a hydrophilic conductive polymer such as polyacetylene, polythiophene, polyaniline, or polypyrrole to form the uneven surface 291. Alternatively, the uneven surface 291 can be formed by etching the surface of the metal plate.

The uneven surface 291 may be formed by micromachining, or an uneven surface 291 having large irregularities may be formed in order to increase the surface area of the cathode flow path 23. For example, an uneven surface 291 having a size of about 0.2 mm may be provided, or a cylinder having a size of about ϕ 0.2 mm and 1 mm in the depth direction may be provided in a flow path having 1 mm in width and 1 mm in depth with a member having conductivity. Particularly, such shape machining is performed at the second half of the cathode flow path 23, and thereby, the performance of trapping the peeled cathode catalyst is improved and the reaction efficiency at the second half of the cathode flow path 23 where the reaction conditions are more severe is improved, resulting in that it is preferable because the electrolysis efficiency is improved in the entire cell. Alternatively, a conductive wire mesh-shaped member may be provided on the surface of the cathode flow path 23, and a fine uneven surface 291 may be provided on the surface to trap the cathode catalyst. Alternatively, in order to reduce the pressure loss in the cathode flow path 23, a honeycomb-shaped conductive member may be provided on the flow path to improve the performance of trapping the peeled catalyst.

Figure 14:
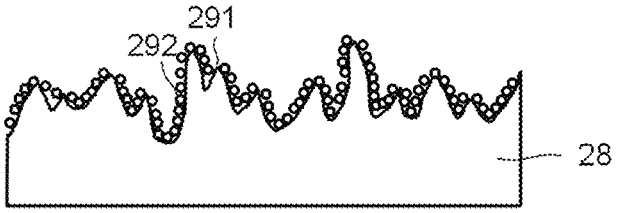
FIG. 14 is a schematic cross-sectional view illustrating a structure example of the cathode flow path plate 28 having a cathode catalyst.

Further, the cathode flow path plate 28 may have a cathode catalyst that is supported beforehand. FIG. 14 is a schematic cross-sectional view illustrating a structure example of the cathode flow path plate 28 having a cathode catalyst. The flow path plate 28 illustrated in FIG. 14 includes the cathode catalyst layer 292 containing the cathode catalyst supported on the uneven surface 291 of the surface 28*a*.

The cathode catalyst layer 292 is preferably formed of a catalyst material (cathode catalyst material) capable of reducing carbon dioxide to produce carbon compounds or capable of reducing the produced carbon compounds to produce carbon compounds as necessary, and capable of reducing an overvoltage in such reactions, for example. Examples of such a material include metals such as gold (Au), silver (Ag), copper (Cu), platinum (Pt), palladium (Pd), nickel (Ni), cobalt (Co), iron (Fe), manganese (Mn), titanium (Ti), cadmium (Cd), zinc (Zn), indium (In), gallium (Ga), lead (Pb), and tin (Sn), metal materials such as alloys containing at least one of these metals and intermetallic compounds, carbon materials such as carbon (C), graphene, CNT (carbon nanotube), fullerene, and ketjen black, and metal complexes such as a Ru complex and a Re complex. This embodiment is not limited to this, and the cathode catalyst layer 292 may use a cathode catalyst material capable of reducing nitrogen to produce ammonia. Examples of such a material include the above-described molybdenum complexes.

The cathode catalyst layer 292 is formed by making a particulate cathode catalyst adhere to the surface 28*a* including the uneven surface 291, for example. Examples of the adhesion method include a method of spraying the particulate cathode catalyst onto the flow path by a spray, and a method of mixing the particulate cathode catalyst with an organic adhesive to facilitate adhesion and spraying the mixture onto the surface 28*a*. Examples of the adhesive include organic materials such as polyvinyl alcohol (PVA). In addition, it is more preferable to use an ion-exchange resin such as Nafion in order to promote the movement of ions.

The cathode catalyst layer 292 may adhere to the entire surface 28*a*, or may adhere only to the recess forming the cathode flow path 23. As a result, the effect can be obtained with a small amount of the cathode catalyst. As a method of supporting the cathode catalyst only in the recess, there is cited a method in which ink obtained by mixing the cathode catalyst and the ion-exchange resin is made to flow through the cathode flow path 23 and then dried or heated to make the ink adhere only to the inner side surface and the inner bottom surface of the recess forming the cathode flow path 23.

At the second half of the cathode flow path 23, particularly, the concentration of $CO_2$ decreases with the reaction and the concentration of the produced gas increases, and thus, the efficiency of the reaction decreases. Therefore, a larger amount of the cathode catalyst is supported on the second half of the cathode flow path 23 in advance, which is more effective. That is, the amount of cathode catalyst supported in the cathode catalyst layer 292 at the second half of the cathode flow path 23 is preferably larger than that of cathode catalyst supported in the cathode catalyst layer 292 at the first half of the cathode flow path 23.

For the cathode catalyst provided in the cathode catalyst layer 292, the same material as the cathode catalyst provided in the cathode catalyst layer 22B may be used, or a material different from the cathode catalyst provided in the cathode catalyst layer 22B may be used. Since the reaction conditions on the surface of the cathode catalyst layer 22B and the reaction conditions on the surface 28*a* are different, it is preferable to change the composition of the cathode catalyst layer. For example, a lower content of ionomer in the cathode catalyst layer 292 than in the cathode catalyst layer 22B is preferable because flooding caused by retention of liquid on the surface 28*a* (a phenomenon in which water inhibits gas diffusion) can be inhibited. This effect can be further improved when the hydrophilic region 280 is provided in particular. Similarly, since the reaction mode on the surface of the cathode catalyst layer 22B and the reaction mode on the surface 28*a* are different, the density, amount, and shape of the cathode catalyst provided in the adhering cathode catalyst layer 292 are preferably made different from those of the cathode catalyst provided in the cathode catalyst layer 22B. The amount of the cathode catalyst in the cathode catalyst layer 292 is preferably smaller than that of the cathode catalyst in the cathode catalyst layer 22B because the case of the surface 28*a* is much more efficient in terms of effectiveness by the adhering cathode catalyst layer 292 and cost. The amount of the cathode catalyst in the cathode catalyst layer 292 is preferably at least 1/10 or less of the amount of the cathode catalyst in the cathode catalyst layer 22B. Further, the density of the cathode catalyst in the cathode catalyst layer 292 is preferably higher than that of the cathode catalyst in the cathode catalyst layer 22B similarly because the case of the surface 28*a* is much more efficient. Therefore, the amount of the cathode catalyst is preferably reduced to cause the reaction only in the cathode flow path 23. When considering the movement of ions between the anode 11 and the cathode 22, a thinner cathode catalyst layer 292 is preferred because the reaction on the cathode flow path 23 is inefficient due to a large amount of movement of ions, and when a thick cathode catalyst layer 292 is formed, the movement of ions becomes more difficult. Regarding the shape of the cathode catalyst layer 292 similarly, the movement of ions on the surface of the cathode catalyst layer 22B is smooth, and thus the cathode flow path 23 having relatively high porosity and high gas diffusibility is preferred. However, the porosity is preferably low on the cathode flow path 23, and in this case, the gas diffusibility therefore deteriorates, resulting in that the cathode catalyst layer 292 is preferably thinner than the cathode catalyst layer 22B. The amount of movement of ions from the anode part 10 is small, and further a cross-sectional area of the flow path is obtained to improve the flow of gas, and thus, the thinner cathode catalyst layer 292 is preferred.

The spatial density of the cathode catalyst layer 292 is preferably lower than that of the cathode catalyst layer 22B, that is, it is preferably sparser, and the thickness is preferably thinner. The cathode catalyst layer 292 preferably has a thickness of at least 1/10 or less of that of the cathode catalyst layer 22B.

The amount of the ionomer as the ion-exchange resin on the surface 28*a* is preferably smaller than that on the surface of the cathode catalyst layer 22B. This is because the reaction is performed on the cathode catalyst immediately through the anode 11 and the membrane and the ions that have not reacted on the cathode catalyst layer 22B react with carbon dioxide, and thus, the amount of reaction is very small, and a smaller amount of the ionomer and a higher ratio of metal particles, or the like of the cathode catalyst to react mainly are preferable for the reaction conditions.

The amount of the cathode catalyst at the second half of the cathode flow path 23 is preferably larger than that at the first half of the cathode flow path 23. This is because the concentration of the substance to be reduced, which is a raw material component, decreases at the second half of the cathode flow path 23, and for performing the reaction in a state with a high concentration of the product, a supporting amount at the second half is preferably large.

In the reaction process at the cathode 22 in the electrolysis operation, the reduction reaction is considered to occur near the boundary between the gas diffusion layer 22A and the cathode catalyst layer 22B, as described above. At this time, the cathode solution flowing through the cathode flow path 21 enters up to the gas diffusion layer 22A and the cathode catalyst layer 22B becomes excessively moist, resulting in that inconveniences such as a decrease in the amount of reduction products due to the reduction reaction and an increase in cell voltage occur. Such a decrease in the cell performance of the electrolysis cell 2 is also caused by uneven distribution of ions or residual gas near the anode 11 and the cathode 22, excess moisture in the cathode catalyst layer 22B, precipitation of electrolyte at the cathode 22 or the anode 11, precipitation of electrolyte in the anode flow path 12 or the cathode flow path 21, or the like.

Further, by the electrolysis operation, salt is precipitated in the cathode flow path 21 or the gas diffusion layer 22A, and due to clogging of the flow path or a decrease in the gas diffusibility, the cell performance decreases in some cases. This is because ions move between the anode 11 and the cathode 22 via the separator 30 and the ion exchange membrane, and these ions react with gas components. For example, when a potassium hydroxide solution is used for the anode solution and a carbon dioxide gas is used for the cathode gas, potassium ions move from the anode part 10 to the cathode part 20, and these ions react with carbon dioxide to produce salt such as potassium hydrogen carbonate or potassium carbonate. In the cathode flow path 21 or the gas diffusion layer 22A, the above salt precipitates in the cathode flow path 21 or the gas diffusion layer 22A when the above salt is equal to or lower than the solubility level. The clogging of the flow path impedes uniform gas flow throughout the cell and the cell performance decreases.

The salt to be precipitated in the cathode flow path 23 is more likely to be precipitated at the first half of the flow path than at the second half. This causes a phenomenon in which the moisture content in the gas diffusion layer increases, the diffusibility of carbon dioxide decreases, and the cell performance decreases. This phenomenon is called flooding.

In response to this, if the salt is equal to or lower than the solubility level, the humidifier 311 is provided to humidify the cathode gas and increase the moisture content, thereby making it possible to prevent salt precipitation. Further, by supplying a rinse solution from the upstream of the cathode flow path 21 or the cathode flow path 23 to dissolve the salt, it is possible to prevent clogging of the flow path caused by precipitation or the like, to inhibit the decrease in performance. It is preferable to minimize the discharge of water from the system as much as possible and to circulate the electrolytic solution in the system as a whole of the electrolytic device 1.

The gas diffusion layer 22A has water repellency for improving the gas diffusibility and the movement of water in the cathode catalyst layer 22B is poor, and thus, it is effective to move water by the hydrophilic region 280. Further, this embodiment is designed in this manner, and thereby, the humidification conditions inside the cell can be made uniform to improve the surface uniformity of the reaction. Particularly, in the case of using an electrolyte membrane, a humidified environment is made uniform, thereby making it possible to inhibit drying of the membrane, optimize the movement of ions at any point within the cell surface, and improve the surface uniformity of the reaction.

The electrolytic solution component moves from the anode part 10 to the cathode part 20 to be discharged from the outlet of the cathode flow path 23 of the electrolysis cell 2 in some cases. Therefore, the outlet of the cathode flow path 23 is connected to the gas/liquid separation part 401 in order to separate the water to be discharged and gas. The electrolytic solution component discharged from the outlet of the cathode flow path 23 is separated by the gas/liquid separation part 401 and stored as liquid.

The electrolytic solution component moves from the anode part 10 to the cathode part 20, and thus, in the anode solution supply system 100, the concentration of the electrolytic solution component in the anode solution decreases and the amount of substances of the electrolytic solution component gradually decreases. These cause the decrease in the cell performance because the cell resistance component decreases and the movement of ions is impeded.

In response to this, the anode solution adjustment system connected to the outlet of the cathode flow path 23 is provided, thereby making it possible to perform a refresh operation that returns the liquid containing the electrolytic solution component separated by the gas/liquid separation part 401 to an anode electrolytic solution circulation path of the anode solution supply system 100.

Figure 15:
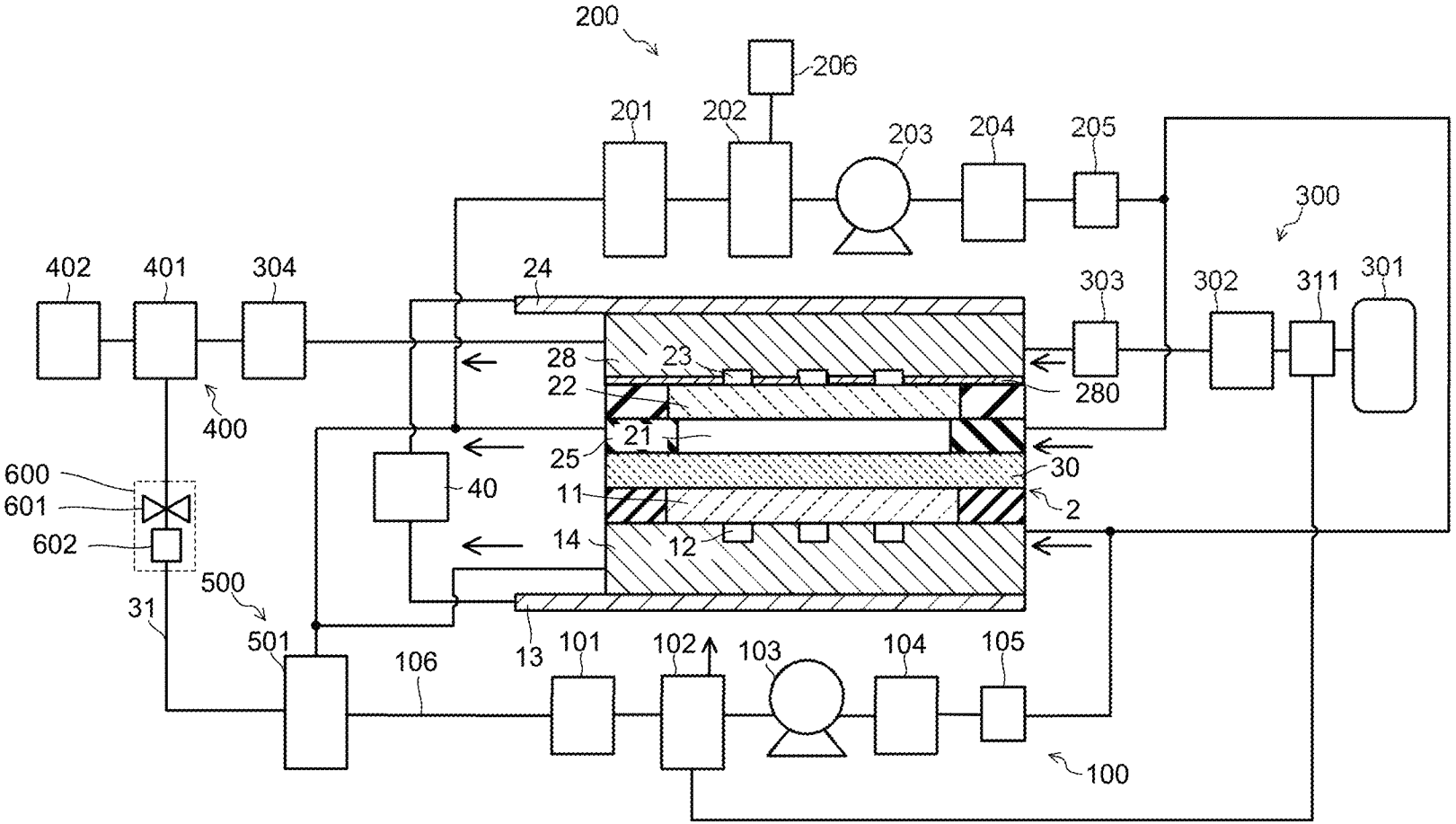
FIG. 15 is a diagram illustrating another configuration example of the electrolytic device.

FIG. 15 is a schematic diagram illustrating another configuration example of the electrolytic device 1. The electrolytic device 1 illustrated in FIG. 15 differs from the electrolytic device 1 illustrated in FIG. 1 in that it further includes the anode solution adjustment system 600.

The anode solution adjustment system 600 is provided in the middle of a flow path 31 connecting the product collection system 400 and the waste liquid collection system 500. The flow path 31 is formed of a pipe, for example. The anode solution adjustment system 600 includes a valve 601 and a filter 602. The filter 602 can collect the cathode catalyst from the electrolytic solution separated by the gas/liquid separation part 401. For example, the anode solution adjustment system 600 can open the valve 601, for example, and feed the electrolytic solution separated by the gas/liquid separation part 401 to the waste liquid collection tank 501 via the filter 602.

In this operation, the amount of water by the gas/liquid separation part varies depending on parameters such as the temperature of the electrolytic solution and the temperature of the gas discharged from the cathode flow path 23, and thus, the amount of the electrolytic solution to circulate varies. Therefore, in order to adjust the electrolytic solution, pure water or a high-concentration electrolytic solution may be supplied from the outside to adjust the concentration.

When the peeled cathode catalyst or the carrier supporting the cathode catalyst is discharged through the cathode flow path 23 by the refresh operation, the cathode catalyst enters the anode solution supply system 100 to impede side reactions or reactions, resulting in that the cell performance decreases.

In response to this, by forming the uneven surface 291 and trapping the peeled cathode catalyst or the carrier supporting the cathode catalyst by the uneven surface 291, the cathode catalyst can be inhibited from entering the anode solution supply system 100.

Even with these measures to trap the peeled cathode catalyst, the cathode catalyst may still be discharged from the cathode flow path 23. Therefore, by providing the filter 602 in the middle of the flow path through which the liquid containing the electrolytic solution component is returned to the anode solution supply system 100 to trap the cathode catalyst, the pressure loss in the cathode flow path 23 can be inhibited and the cathode catalyst can be inhibited from entering the anode solution supply system 100 even if the cathode catalyst is mixed with the electrolytic solution component. In addition, since the cathode catalyst is not mixed into the anode solution, there is also an effect of suppressing the influence of impurities in the oxidation reaction and maintaining the efficiency. Further, the cathode catalyst can be collected from the filter 602 while inhibiting the release of catalyst particles to the outside. The particles of the cathode catalyst peeled off from the cathode flow path 23 are conductive, and thus, when the electrolysis cells 2 are stacked, current flows between the flow paths through the catalyst particles, causing a decrease in the reaction efficiency. Therefore, it is preferable that the catalyst particles peeled off in the cells are as small as possible.

The case where the filter 602 is located between the outlet of the cathode flow path 23 and the gas/liquid separation part 401 has an advantage that the peeled catalyst is not mixed into the liquid after the gas/liquid separation, but it is necessary to consider controlling the cathode pressure because the pressure loss of the filter occurs. If the filter 602 is provided between the liquid tank of the gas/liquid separation part 401 and the waste liquid collection tank 501 or the anode flow path 12, there is no need to consider the pressure loss of the filter 602. However, there is sometimes a case that the peeled catalyst particles are mixed in the gas released from the gas/liquid separation part 401, and if it becomes necessary to prepare a filter or the like for this case, the pressure loss will occur again. However, as long as the filter 602 is to trap the peeled cathode catalyst, the pressure loss is smaller in the case of gas, and therefore, the pressure loss is smaller as compared to the case where the filter 602 is installed between the outlet of the cathode flow path 23 and the gas/liquid separation part 401.

Figure 16:
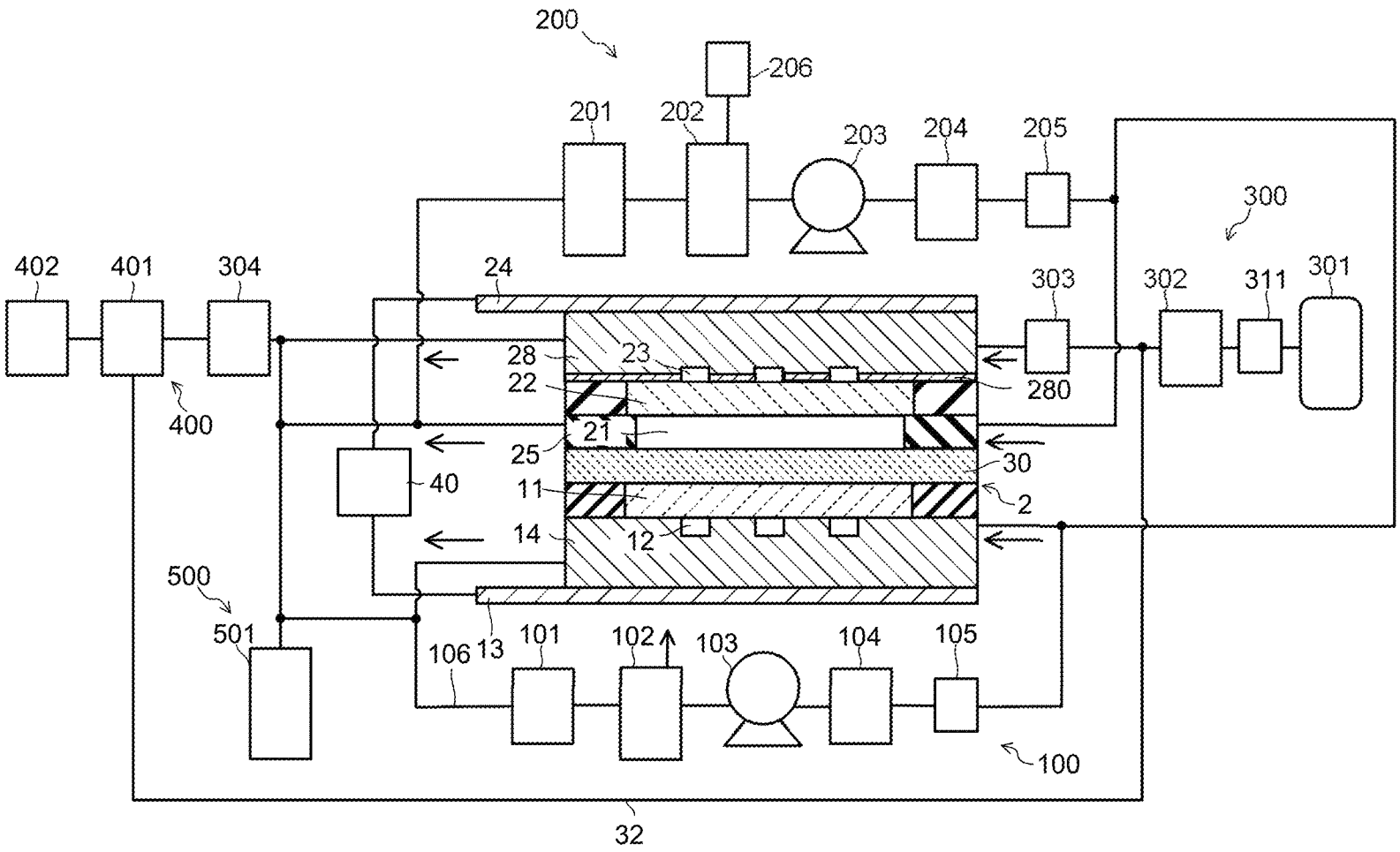
FIG. 16 is a diagram illustrating another configuration example of the electrolytic device.

When the separated liquid contains water, the liquid can also be returned to the humidifier 311 to produce water for humidifying the cathode gas. FIG. 16 is a schematic diagram illustrating another configuration example of the electrolytic device 1. The electrolytic device 1 illustrated in FIG. 16 differs from the electrolytic device 1 illustrated in FIG. 1 in that it further includes a flow path 32 that connects the gas/liquid separation part 401 and the inlet of the cathode flow path 23.

By returning the liquid to the humidifier 311, the discharge of water to the outside of the system by the water vapor in the exhaust gas from the cathode flow path 23 or in the oxygen gas from the anode flow path 12 is reduced. The original water is the water produced by the reaction in the humidifier 311 and the water formed by the electrolytic solution moving to the cathode part 20. The humidifier 311 requires an external supply of water because the amount of water in the humidifier 311 decreases significantly.

When the liquid trapped from the outlet of the cathode flow path 23 is used as water for humidification of the humidifier 311, a filter is provided at the humidifier 311, thereby making it possible to prevent impurities such as catalyst particles from entering the humidifier 311. The function of trapping not only the peeled cathode catalyst but also a gasket or the separator 30 washed away from the electrolysis cell 2, the carbon particles peeled off from the gas diffusion layer 22A, and the like can also be given to the filter. This filter can inhibit impurities from entering the anode solution or the humidifier 311. Further, the function of trapping ion components eluted from the electrolysis cell 2, pipes, or the like, may also be added to the filter. Metal ion components from the pipes or cells cause the decrease in the cell performance when using catalysts or isolation membranes, particularly electrolyte membranes, so that it is preferable to trap ions.

When the separated liquid contains the electrolytic solution component, the electrolytic solution component is mixed into the cathode gas via the humidifier 311, which suppresses the effect of preventing salt precipitation in some cases. Further, the humidifier 311 also needs to be fabricated with specifications that are resistant to the electrolytic solution component, which is not preferable because it increases the cost.

Thus, gas/liquid separation is performed between the oxygen gas from the outlet of the anode flow path 12 and the electrolytic solution to cool the water vapor in the oxygen gas, and the water obtained by the gas/liquid separation is used as the water for the humidifier on the upstream side of the cathode. As a result, the water obtained by cooling the water vapor in the oxygen gas and performing the gas/liquid separation is distilled water and the concentration of the electrolytic solution component is extremely low. Therefore, it is preferable because the effect of preventing salt precipitation is maintained and there is no need to consider the resistance to the electrolytic solution component of the humidifier 311.

Figure 17:
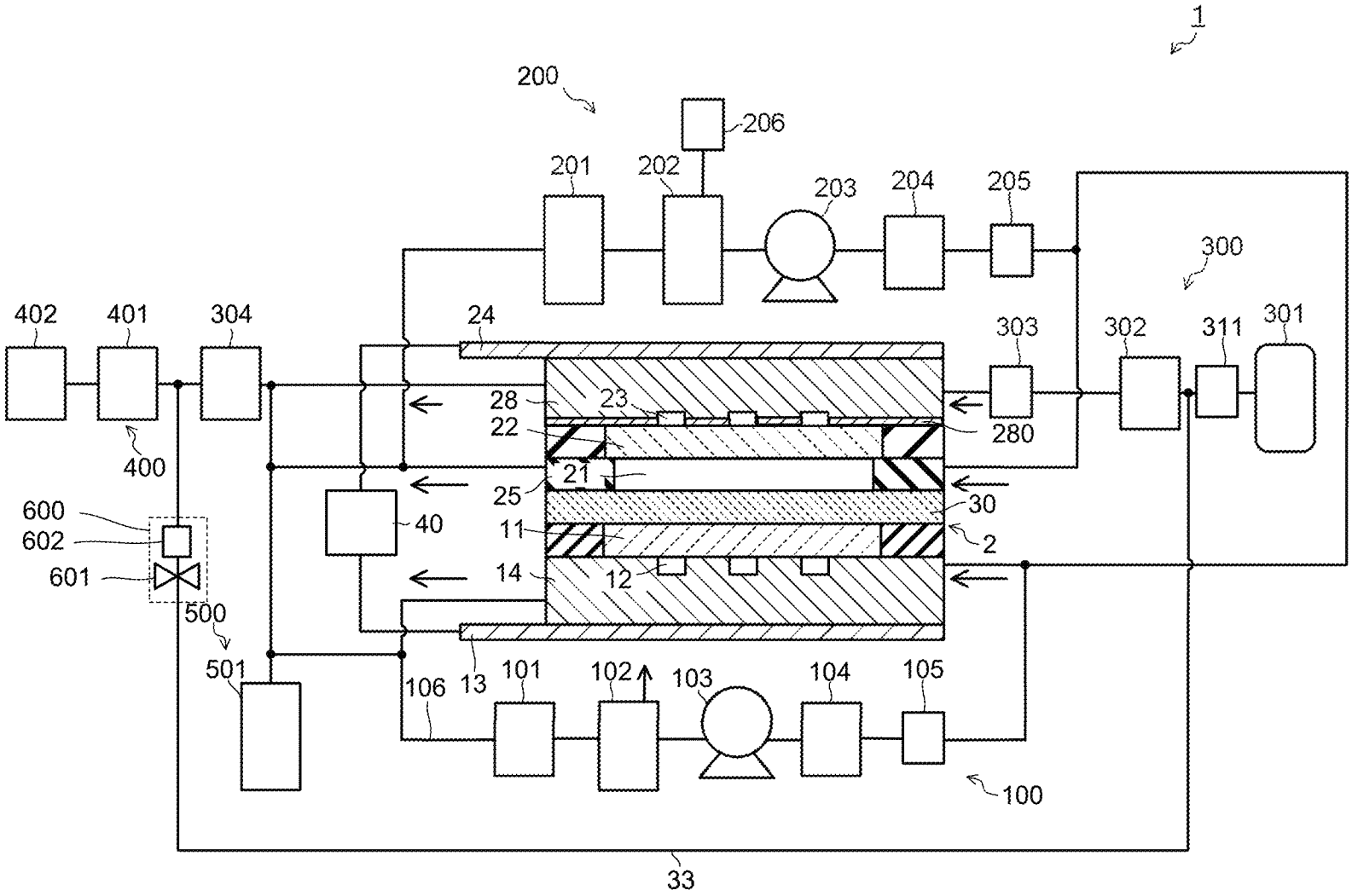
FIG. 17 is a diagram illustrating another configuration example of the electrolytic device.

The peeled cathode catalyst is accumulated in a tank that stores the liquid separated by the gas/liquid separation part 401. On the other hand, the electrolysis cell 2 decreases in cell performance due to a decrease in the amount of catalyst. Thus, the accumulated cathode catalyst is returned from the inlet of the cathode flow path 23, which allows the catalyst to adhere to the cathode catalyst layer 22B or the cathode flow path 23 to compensate for the reduced catalyst in the cathode catalyst layer 22B, resulting in that it is possible to inhibit the decrease in the cell performance and operate the electrolytic device 1 while maintaining efficiency for a long period of time. Furthermore, the uneven surface 291 makes it easier for the cathode catalyst to adhere, and thus, it is possible to improve the effect of inhibiting the decrease in the cell performance. Further, as illustrated in FIG. 17, the anode solution adjustment system 600 is provided, and as the configuration in which the catalyst from the filter 602 is collected and the catalyst is returned from the upstream side of the cathode flow path 23, the filter 602 and the inlet of the cathode flow path 23 are connected by a flow path 33, and at the stage when a certain amount of catalyst is accumulated, it is preferable to compensate for the reduced catalyst in the cathode catalyst layer 22B while performing the reaction. If the filter 602 is provided directly at the outlet of the cathode flow path 23, the pressure loss in the entire cathode flow path 23 increases, which may result in a decrease in efficiency in the system. The explanation of the anode solution adjustment system 600 illustrated in FIG. 15 can be used as appropriate for the other explanation of the anode solution adjustment system 600. The flow path 32 and the flow path 33 are formed of a pipe, for example.

The electrolytic device in the embodiment is not limited to the carbon dioxide electrolytic device, and may be a nitrogen electrolytic device, for example. In the case of a nitrogen electrolytic device, a nitrogen ($N_2$) gas can be supplied from the cathode gas supply source 301 to the cathode flow path 23, and the nitrogen gas can be reduced by the cathode 22 to produce ammonia. The configuration of the carbon dioxide electrolytic device can be used as appropriate for the other configuration of the nitrogen electrolytic device.

EXAMPLES

Example 1

The electrolytic device illustrated in FIG. 1 was assembled to examine carbon dioxide electrolysis performance. First, the cathode, in which carbon particles supporting gold nanoparticles were coated on a carbon paper provided with a porous layer, was fabricated by the following procedure. A coating solution was prepared by mixing carbon particles supporting gold nanoparticles with pure water, a Nafion solution, and ethylene glycol. An average particle diameter of the gold nanoparticles was 8.7 nm, and a supporting amount was 18.9 mass %. The coating solution was filled into an airbrush and spray-coated onto the carbon paper provided with the porous layer by using a nitrogen gas. After the coating, this was washed under running water with pure water for 30 minutes, and then immersed in a hydrogen peroxide solution to oxidize and remove organic substances such as ethylene glycol. This was cut out to a size of 2×2 cm to be used as the cathode. A coating amount of Au was estimated to be about 0.2 mg/cm 2 based on the amount of the gold nanoparticles and the carbon particles mixed in the coating solution. For the anode, an electrode in which $IrO_2$ nanoparticles being a catalyst were coated on a Ti nonwoven fabric was used. $IrO_2$/Ti mesh cut out to a size of 2×2 cm was used as the anode. A catalyst area was set to 2 cm×2 cm=4 $cm^2$. The area of the cathode catalyst layer 22B on a contact surface with the surface 28*a* was 4 $cm^2$, the distance between the inlet IN and the outlet OUT was 0.8 cm, and the distance between the inlet IN and the outlet OUT/√ the area of the cathode catalyst layer 22B=0.2 was established.

Figure 18:
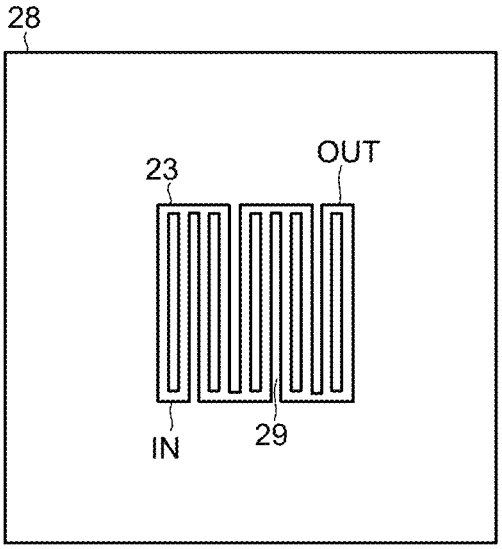
FIG. 18 is a view illustrating a planar shape of a cathode flow path in Example 1.

As illustrated in FIG. 2, the electrolysis cell 2 was fabricated in a manner that the cathode current collector plate 24, the cathode flow path 23 (flow path plate 28), the cathode 22, the cathode flow path 21 (flow path plate 25), the separator 30, the anode 11, the anode flow path 12, and the anode current collector plate 13 were stacked in this order from the top, and the stack was sandwiched between not-illustrated support plates and tightened by bolts. For the separator 30, an anion exchange membrane (product name: Selemion) was used. The $IrO_2$/Ti mesh of the anode 11 was brought into close contact with the anion exchange membrane. The thickness of the cathode flow path 23 was set to 1 mm. The flow path plate 28 was made of titanium. The cathode flow path 23 was fabricated by cutting the flow path plate 28. The planar shape of the cathode flow path 23 is illustrated in FIG. 18. The planar shape of the cathode flow path 23 was serpentine and had four folded portions. Further, the cathode flow path 23 had four pairs of parallel flow path regions that were connected in parallel on the surface 28*a*. The width of the cathode flow path 23 was 1 mm. The depth of the cathode flow path 23 in the thickness direction of the flow path plate 28 was 1 mm. The width of the land 29 was 1 mm.

The contact surface of the flow path plate 28 with the gas diffusion layer 22A had the uneven surface 291 having a surface roughness (width of each irregularity) of 30 nm or more and 10 μm or less through a surface treatment. The average roughness (arithmetic mean roughness) of the uneven surface 291 was about 0.3±0.1 μm.

The electrolytic device 1 illustrated in FIG. 1 was assembled using the above-described electrolysis cell 2, and the electrolytic device was operated under the following conditions. The cell was heated to 50° C., a $CO_2$ gas humidified at 45° C. was supplied to the cathode flow path 23 of the electrolysis cell 2 at 20 sccm, and a potassium hydrogen carbonate solution (concentration of 1 M $KHCO_3$) was supplied to the anode flow path 12 at a flow rate of 20 mL/min. Then, a constant current of 800 mA was applied between the anode 11 and the cathode 22 at a constant current density of 200 mA/cm$^2$ by controlling the voltage by the power supply control part 40 to cause an electrolytic reaction of $CO_2$ for a predetermined time, and the cell voltage at that time was measured and collected by a data collection and control part. Further, part of the gas output from the cathode flow path 23 was collected, and the production amount of CO gas produced by the reduction reaction of $CO_2$ and the production amount of $H_2$ gas produced by the reduction reaction of water were analyzed by a gas chromatograph. A partial current density of CO or $H_2$ and Faradaic efficiency, which is a ratio of the total current density to the partial current density, were calculated and collected by the data collection and control part based on the gas production amounts. Results are illustrated in Table 1.

Example 2

The carbon dioxide electrolytic device was assembled in the same manner as in Example 1, to examine the carbon dioxide electrolysis performance. Unlike Example 1, on the surface 28*a* of the flow path plate 28, the hydrophilic region 280 was formed by making a hydrophilic carbon powder adhere only to the inner side surface and the inner bottom surface of the recess forming the cathode flow path 23. The hydrophilic region 280 had a surface roughness of 20 nm or more and 5 μm or less, and the average roughness was about 3±1 μm.

Example 3

Using the flow path in Example 2, a glass container having a volume of 50 cc was provided at the outlet of the cathode flow path 23 to perform gas/liquid separation. The accumulated liquid was passed through a 0.01 μm mesh filter and returned to the 1 L anode solution tank 102 by a pump. The fluid discharged from the anode flow path 12 was separated into gas and liquid in the gas/liquid separation part 401 and the anode solution tank 102, the released gas was cooled, water vapor was captured, and distilled water was accumulated in a 100 ml glass tank. After a certain amount of the distilled water was accumulated, the distilled water was returned to the humidifier 311 on the upstream side of the cathode flow path to examine the carbon dioxide electrolysis performance as in Example 2.

Example 4

The carbon dioxide electrolytic device was assembled in the same manner as in Example 3, to examine the carbon dioxide electrolysis performance. As in Example 2, the cathode catalyst powder and the ionomer were made to adhere to the inner side surface and the inner bottom surface of the recess forming the cathode flow path 23 to have a thickness of 1 μm under the same conditions as those of the cathode catalyst layer 22B, and the reaction was performed.

Comparative Example 1

The carbon dioxide electrolytic device was assembled in the same manner as in Example 1, to examine the carbon dioxide electrolysis performance. Unlike Example 1, the uneven surface 291 formed on the surface 28*a* of the flow path plate had a surface roughness of 0.02 μm or less, and the average roughness was about 0.01 to 0.05 μm. After 320 hours, salt precipitated in the flow path and the flow path was clogged therewith, thus making it impossible to continue the reaction.

Table 1 illustrates a collected cell voltage, Faradaic efficiency of CO (F. E. (CO)), and Faradaic efficiency of $H_2$ (F. E. ($H_2$)) in Examples 1, 2, 3, and 4 and Comparative example 1.

TABLE 1

| Time | | Example 1 | Example 2 | Example 3 | Example 4 | Comparative example 1 |
|---|---|---|---|---|---|---|
| 10 h | Voltage (V) | 2.53 ± 0.05 | 2.53 ± 0.04 | 2.53 ± 0.05 | 2.52 ± 0.04 | 2.54 ± 0.05 |
| | F.E(CO)(%) | 98.0 | 98.4 | 98.1 | 98.4 | 98.2 |
| | F.E($H_2$)(%) | 1.5 | 1.5 | 1.5 | 1.5 | 1.6 |
| 100 h | Voltage (V) | 2.75 ± 0.25 | 2.72 ± 0.2 | 2.73 ± 0.2 | 2.67 ± 0.1 | 2.89 ± 0.2 |
| | F.E(CO)(%) | 96.5 | 97.0 | 97.0 | 97.0 | 95.0 |
| | F.E($H_2$)(%) | 2.0 | 1.8 | 1.9 | 1.6 | 2.8 |
| 200 h | Voltage (V) | 2.98 ± 0.1 | 2.82 ± 0.09 | 2.81 ± 0.10 | 2.76 ± 0.1 | 3.40 ± 0.27 |
| | F.E(CO)(%) | 95.3 | 96.2 | 96.5 | 96.8 | 91.5 |
| | F.E($H_2$)(%) | 2.5 | 2.4 | 2.3 | 2.2 | 6.4 |
| 500 h | Voltage (V) | 3.03 ± 0.08 | 2.98 ± 0.17 | 2.97 ± 0.20 | 2.83 ± 0.23 | — |
| | F.E(CO) | 94.8 | 95.9 | 96.2 | 94.2 | — |
| | F.E($H_2$)(%) | 3.0 | 2.5 | 2.5 | 2.2 | — |

The results of Examples 1, 2, 3, and 4 and Comparative example 1 reveal that forming the uneven surface 291 and supporting the cathode catalyst on the uneven surface 291 make it possible to inhibit the decrease in Faradaic efficiency of CO even after a long-term electrolytic reaction, and inhibit the decrease in cell performance.

It should be noted that the structures of the above-described embodiments may be employed in combination, or part thereof may be modified. While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The above-described embodiment can be summarized into the following clauses.

(Clause 1)

An electrolytic device, comprising:

an electrolysis cell comprising:

an anode;

a cathode;

a first flow path plate facing on the anode, the first flow path plate having a first recess defining an anode flow path through which a first liquid flows;

a second flow path plate facing on the cathode, the second flow path plate having a second recess defining a cathode flow path through which a first gas flows; and a separator provided between the anode and the cathode, wherein the second flow path plate has an uneven surface on an inner surface of the second recess, and an arithmetic mean roughness of the uneven surface is 0.03 μm or more and 50 μm or less.

(Clause 2)

The electrolytic device according to the clause 1, wherein the anode is configured to oxidize water in the first liquid to produce oxygen, and the cathode is configured to reduce carbon dioxide in the first gas to produce a carbon compound.

(Clause 3)

The electrolytic device according to the clause 1, wherein the anode is configured to oxidize water in the first liquid to produce oxygen, and the cathode is configured to reduce nitrogen in the first gas to produce ammonia.

(Clause 4)

The electrolytic device according to any one of the clause 1 to the clause 3, wherein the second flow path plate has a first cathode catalyst layer containing a first cathode catalyst on the uneven surface.

(Clause 5)

The electrolytic device according to the clause 4, wherein the second half of the cathode flow path has a larger amount of the first cathode catalyst than the first half of the cathode flow path.

(Clause 6)

The electrolytic device according to the clause 5, wherein the cathode has a second cathode catalyst layer containing a second cathode catalyst, and the second cathode catalyst layer has a smaller amount of ionomer than the first cathode catalyst layer.

(Clause 7)

The electrolytic device according to any one of the clause 4 to the clause 6, wherein the cathode has a second cathode catalyst layer containing a second cathode catalyst, and the density of the first cathode catalyst in the first cathode catalyst layer is lower than the density of the second cathode catalyst in the second cathode catalyst layer.

(Clause 8)

The electrolytic device according to the clause 7, wherein the density of the first cathode catalyst in the first cathode catalyst layer is 1/10 or less of the density of the second cathode catalyst in the second cathode catalyst layer.

(Clause 9)

The electrolytic device according to any one of the clause 1 to the clause 8, further comprising:

a gas/liquid separation part configured to separate the first liquid from a first fluid discharged from the cathode flow path, the gas/liquid separation part comprising a first tank configured to accommodate the separated first liquid;

a first flow path connecting an inlet and an outlet of the anode flow path and configured to circulate the first liquid;

a second tank provided in the middle of the first flow path and configured to accommodate the first liquid;

a second flow path connecting the first tank and the first flow path; and a first filter provided in the middle of the second flow path.

(Clause 10)

The electrolytic device according to the clause 9, further comprising:

a third flow path connecting the first tank and an inlet of the cathode flow path.

(Clause 11)

The electrolytic device according to the clause 10, further comprising:

a humidifier connected to the third flow path.

(Clause 12)

The electrolytic device according to the clause 11, wherein the humidifier is connected to the first flow path.

(Clause 13)

The electrolytic device according to any one of the clause 9 to the clause 12, further comprising:

a second filter provided in the middle of the first flow path.

(Clause 14)

The electrolytic device according to any one of the clause 1 to the clause 13, wherein at least a part of the surface of the cathode flow path is hydrophilic.

What is claimed is:

1. An electrolytic device, comprising:

an electrolysis cell comprising:

an anode;

a cathode;

a first flow path plate facing on the anode, the first flow path plate having a first recess defining an anode flow path through which a first liquid flows;

a second flow path plate facing on the cathode, the second flow path plate having a second recess defining a cathode flow path through which a first gas flows; and a separator provided between the anode and the cathode, wherein the second flow path plate has an uneven surface on an inner surface of the second recess, an arithmetic mean roughness of the uneven surface is 0.03 μm or more and 50 μm or less, the second flow path plate has a first cathode catalyst later containing a first cathode catalyst on the uneven surface, and a second half of the cathode flow path has a larger amount of the first cathode catalyst than a first half of the cathode flow path, the first half being a portion closer to an inlet of the cathode flow path than an outlet of the cathode flow path along a length direction of the cathode flow path, and the second half being a portion closer to the outlet than the inlet along the length direction of the cathode flow path.

2. The electrolytic device according to claim 1, wherein the anode is configured to oxidize water in the first liquid to produce oxygen, and the cathode is configured to reduce carbon dioxide in the first gas to produce a carbon compound.

3. The electrolytic device according to claim 1, wherein the anode is configured to oxidize water in the first liquid to produce oxygen, and the cathode is configured to reduce nitrogen in the first gas to produce ammonia.

4. The electrolytic device according to claim 1, further comprising:

a gas/liquid separation part configured to separate the first liquid from a first fluid discharged from the cathode flow path indicated as a separated first liquid, the gas/liquid separation part comprising a first tank configured to accommodate the separated first liquid;

a first flow path connecting an inlet and an outlet of the anode flow path and configured to circulate the first liquid;

a second tank provided in a middle of the first flow path and configured to accommodate the first liquid;

a second flow path connecting the first tank and the first flow path; and a first filter provided in a middle of the second flow path.

5. The electrolytic device according to claim 4, further comprising:

a third flow path connecting the first tank and an inlet of the cathode flow path.

6. The electrolytic device according to claim 5, further comprising:

a humidifier connected to the third flow path.

7. The electrolytic device according to claim 6, wherein the humidifier is connected to the first flow path.

8. The electrolytic device according to claim 4, further comprising:

a second filter provided in the middle of the first flow path.

9. The electrolytic device according to claim 1, wherein at least a part of the uneven surface of the cathode flow path is hydrophilic.

10. The electrolytic device according to claim 1, further comprising:

a gas/liquid separation part configured to separate the first liquid from a first fluid discharged from the cathode flow path indicated as a separated first liquid, the gas/liquid separation part comprising a first tank configured to accommodate the separated first liquid;

a first flow path connecting an inlet and an outlet of the anode flow path and configured to circulate the first liquid;

a second tank provided in a middle of the first flow path and configured to accommodate the first liquid;

a second flow path connecting the first tank and the first flow path; and a first filter provided in a middle of the second flow path, wherein the second flow path plate has a first cathode catalyst layer containing a first cathode catalyst on the uneven surface.

11. The electrolytic device according to claim 10, further comprising:

a third flow path connecting the first tank and an inlet of the cathode flow path.

12. The electrolytic device according to claim 11, further comprising:

a humidifier connecting the first flow path and the third flow path.

13. The electrolytic device according to claim 1, further comprising:

a gas/liquid separation part configured to separate the first liquid from a first fluid discharged from the cathode flow path indicated as a separated first liquid, the gas/liquid separation part comprising a first tank configured to accommodate the separated first liquid;

a first flow path connecting an inlet and an outlet of the anode flow path and configured to circulate the first liquid;

a second tank provided in a middle of the first flow path and configured to accommodate the first liquid;

a second flow path connecting the first tank and the first flow path; and a first filter provided in a middle of the second flow path, wherein the cathode has a second cathode catalyst layer containing a second cathode catalyst, and the second cathode catalyst layer has a smaller amount of ionomer than a first cathode catalyst layer.

14. The electrolytic device according to claim 13, further comprising:

a third flow path connecting the first tank and an inlet of the cathode flow path.

15. The electrolytic device according to claim 14, further comprising:

a humidifier connecting the first flow path and the third flow path.

16. An electrolytic device, comprising:

an electrolysis cell comprising:

an anode;

a cathode;

a first flow path plate facing on the anode, the first flow path plate having a first recess defining an anode flow path through which a first liquid flows;

a second flow path plate facing on the cathode, the second flow path plate having a second recess defining a cathode flow path through which a first gas flows; and a separator provided between the anode and the cathode, wherein the second flow path plate has an uneven surface on an inner surface of the second recess, an arithmetic mean roughness of the uneven surface is 0.03 μm or more and 50 μm or less, the second flow path plate has a first cathode catalyst layer containing a first cathode catalyst on the uneven surface, the cathode has a second cathode catalyst layer containing a second cathode catalyst, and the second cathode catalyst layer has a smaller amount of ionomer than the first cathode catalyst layer.

17. An electrolytic device, comprising:

an electrolysis cell comprising:

an anode;

a cathode;

a first flow path plate facing on the anode, the first flow path plate having a first recess defining an anode flow path through which a first liquid flows;

a second flow path plate facing on the cathode, the second flow path plate having a second recess defining a cathode flow path through which a first gas flows; and a separator provided between the anode and the cathode, wherein the second flow path plate has an uneven surface on an inner surface of the second recess, an arithmetic mean roughness of the uneven surface is 0.03 μm or more and 50 μm or less, the second flow path plate has a first cathode catalyst layer containing a first cathode catalyst on the uneven surface, the cathode has a second cathode catalyst layer containing a second cathode catalyst, and a density of the first cathode catalyst in the first cathode catalyst layer is lower than a density of the second cathode catalyst in the second cathode catalyst layer.

18. The electrolytic device according to claim 17, wherein the density of the first cathode catalyst in the first cathode catalyst layer is 1/10 or less of the density of the second cathode catalyst in the second cathode catalyst layer.

* * * * *